US007044056B2

(12) United States Patent
Miyoshi

(10) Patent No.: US 7,044,056 B2
(45) Date of Patent: May 16, 2006

(54) INTERLEAF REMOVAL APPARATUS, PLATE FEED APPARATUS AND IMAGE RECORDING SYSTEM

(75) Inventor: Hiroshi Miyoshi, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 267 days.

(21) Appl. No.: 10/455,329

(22) Filed: Jun. 6, 2003

(65) Prior Publication Data

US 2003/0231947 A1 Dec. 18, 2003

(30) Foreign Application Priority Data

Jun. 17, 2002 (JP) ..... P2002-175567

(51) Int. Cl.
*B65H 3/08* (2006.01)

(52) U.S. Cl. ..... 101/477; 101/479; 271/91; 271/106; 414/416.07; 414/797

(58) Field of Classification Search ..... 101/477, 101/479, 480; 271/91, 90, 92, 105, 106, 271/107; 414/416.07, 752.1, 797

See application file for complete search history.

(56) References Cited

U.S. PATENT DOCUMENTS

| | | | | |
|---|---|---|---|---|
| 4,311,304 | A * | 1/1982 | Hamada et al. | 271/13 |
| 5,083,763 | A * | 1/1992 | Hartta | 271/20 |
| 5,350,166 | A * | 9/1994 | Shimizu et al. | 271/14 |
| 5,676,364 | A * | 10/1997 | Shiiki et al. | 271/91 |
| 6,422,801 | B1 * | 7/2002 | Solomon | 414/416.07 |
| 6,530,322 | B1 | 3/2003 | Ono et al. | |
| 6,739,588 | B1 * | 5/2004 | Koster et al. | 271/106 |
| 6,776,097 | B1 * | 8/2004 | Takeda | 101/477 |
| 2001/0011513 | A1 * | 8/2001 | Ono et al. | 101/477 |
| 2004/0108650 | A1 * | 6/2004 | Shibabuki et al. | 271/91 |

FOREIGN PATENT DOCUMENTS

| | | |
|---|---|---|
| JP | 2001-39568 A | 2/2001 |
| JP | 99208909 | 2/2001 |
| JP | 2002234623 | 3/2004 |
| WO | WO 00/73183 A1 | 12/2000 |

* cited by examiner

*Primary Examiner*—Leslie J. Evanisko
(74) *Attorney, Agent, or Firm*—McDermott Will & Emery LLP

(57) ABSTRACT

A stack of alternating plates and interleaves are stored in a cassette of a plate feed apparatus. An interleaf is removed from the stack by a plurality of vertically moving suction cups. There are cases where a plate is attached to the back surface of the interleaf during the removal. Lifting up the plurality of suction cups being reciprocated horizontally causes the plate attached to the interleaf to drop off.

8 Claims, 23 Drawing Sheets

INTERLEAF REMOVAL APPARATUS, PLATE FEED APPARATUS AND IMAGE RECORDING SYSTEM

BACKGROUND OF THE INVENTION

1. Field of the Invention

The present invention relates to an interleaf removal apparatus for removing interleaves (or slip sheets) out of a storage part in which a stack of alternating plates and interleaves are stored, in a plate feed apparatus for an image recording system for forming an image on a plate.

2. Description of the Background Art

A plate feed apparatus automatically feeds a plate to an image recorder for directly recording an image on the plate by directing laser light onto the plate. An interleaf removal apparatus is used in such a plate feed apparatus.

A plurality of plates and a plurality of interleaves for preventing the plates from rubbing against each other are alternately vertically stacked in a cassette in the plate feed apparatus.

The interleaf removal apparatus holds and fixes an interleaf under suction by means of a movable suction cup and moves the suction cup to a predetermined position, with the interleaf fixed in this manner, to remove the interleaf outwardly of the plate feed apparatus each time a plate is taken out of the cassette by means of a movable arm or the like.

Unfortunately, the suction cup for holding the interleaf under suction sometimes also attracts the plate on the back surface of the interleaf, with the interleaf between the suction cup and the plate, depending on environmental conditions such as the type of interleaf and static electricity. In this case, jamming occurs to result in a failure to successfully remove the interleaf. Moreover, there is a likelihood that the plate accidentally held under suction by the interleaf-holding suction cup damages other plates in the cassette.

To solve such a problem, a conventional apparatus vertically vibrates the interleaf-holding suction cup during the transport of the interleaf to shake off the plate attached to the back surface of the interleaf. Another conventional technique for preventing the plate from attaching to the interleaf is such that a scraper or spatula placed near an interleaf-removing suction cup is used to rub the front surface of the interleaf to bring the interleaf partly out of contact with the plate, and the suction cup is attached to the interleaf in this condition under suction (as disclosed in Japanese Patent Application Laid-Open No. 2001-39568 by the same assignee as the present invention).

In the first background art technique, there is a likelihood that the plate is not reliably removed from the interleaf.

In the second background art technique, the scraper sometimes fails to sufficiently bring the interleaf partly out of contact with the plate if the interleaf-removing suction cup when holding the interleaf under suction is at an improper height. This brings about an unsuccessful result such that not only the interleaf but also the plate is held under suction by the suction cup.

SUMMARY OF THE INVENTION

The present invention is intended for an interleaf removal apparatus provided in a plate feed apparatus constituting an image recording system for recording an image on a plate, the interleaf removal apparatus removing an interleaf from a storage part of the plate feed apparatus.

According to the present invention, the interleaf removal apparatus for removing an interleaf from a stack of alternating plates and interleaves, comprises: (a) a plurality of suction cups for holding and fixing an interleaf under suction; (b) a support for supporting the plurality of suction cups; (c) a lifting element for vertically moving the plurality of suction cups together with the support with respect to the stack; (d) a suction element for causing the plurality of suction cups to exert suction; and (e) a suction cup moving element for moving at least one of the plurality of suction cups toward and away from the remainder of the plurality of suction cups.

Preferably, the suction cup moving element moves the at least one suction cup after the plurality of suction cups holding the interleaf under suction have been lifted up to a predetermined vertical position by the lifting element.

If a plate is attached to the back surface of the interleaf and lifted up together with the interleaf, the interleaf removal apparatus produces a clearance between the interleaf and the plate resulting from a difference in flexural rigidity therebetween as the at least one suction cup moves, to cause the plate to easily drop off under its own weight, thereby satisfactorily separating the plate from the interleaf.

It is therefore an object of the present invention to reliably remove only an interleaf out of a storage part of a plate feed apparatus in which a stack of alternating plates and interleaves are stored.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
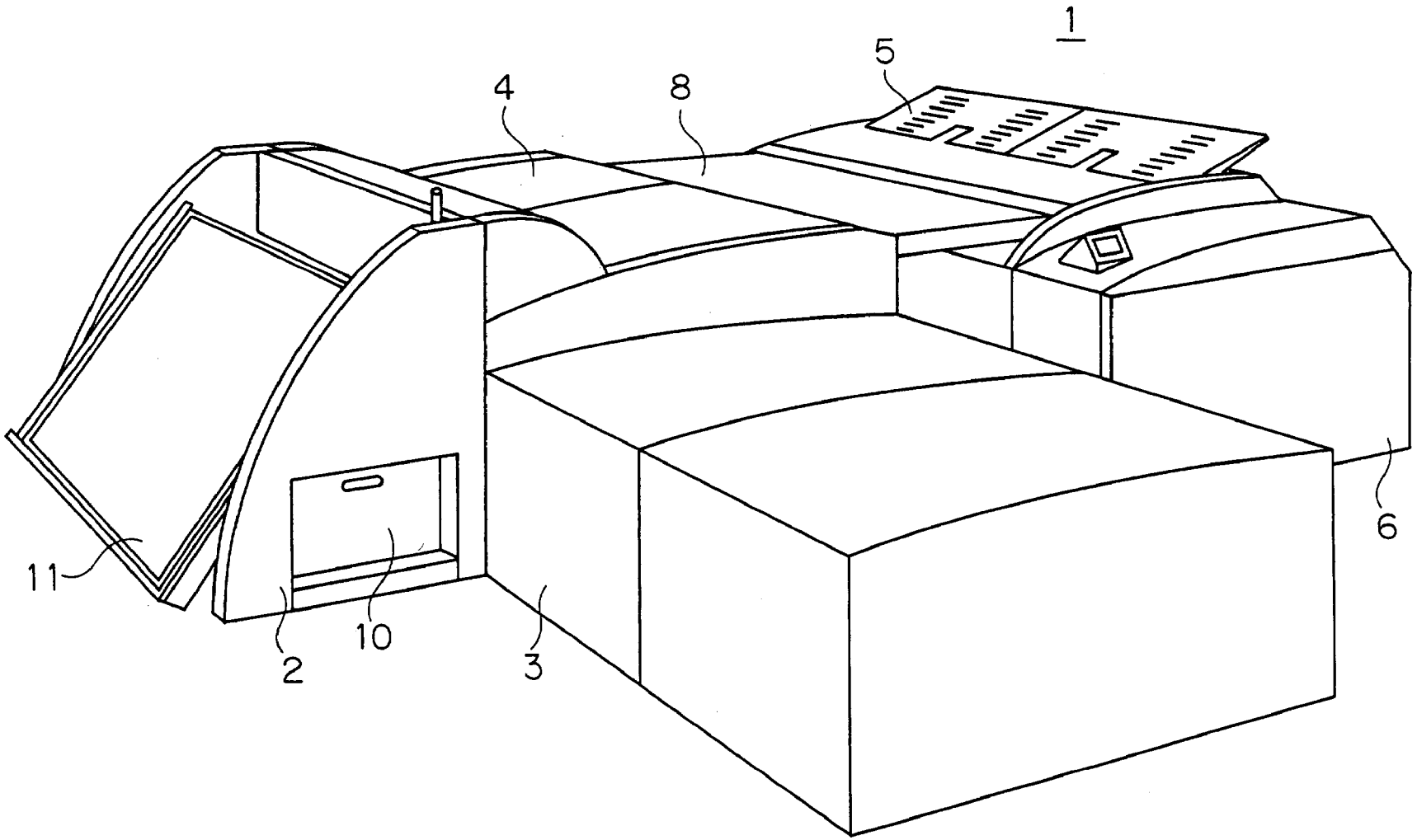
FIG. 1 is a perspective view of an image recording system according to the present invention.
Figure 2:
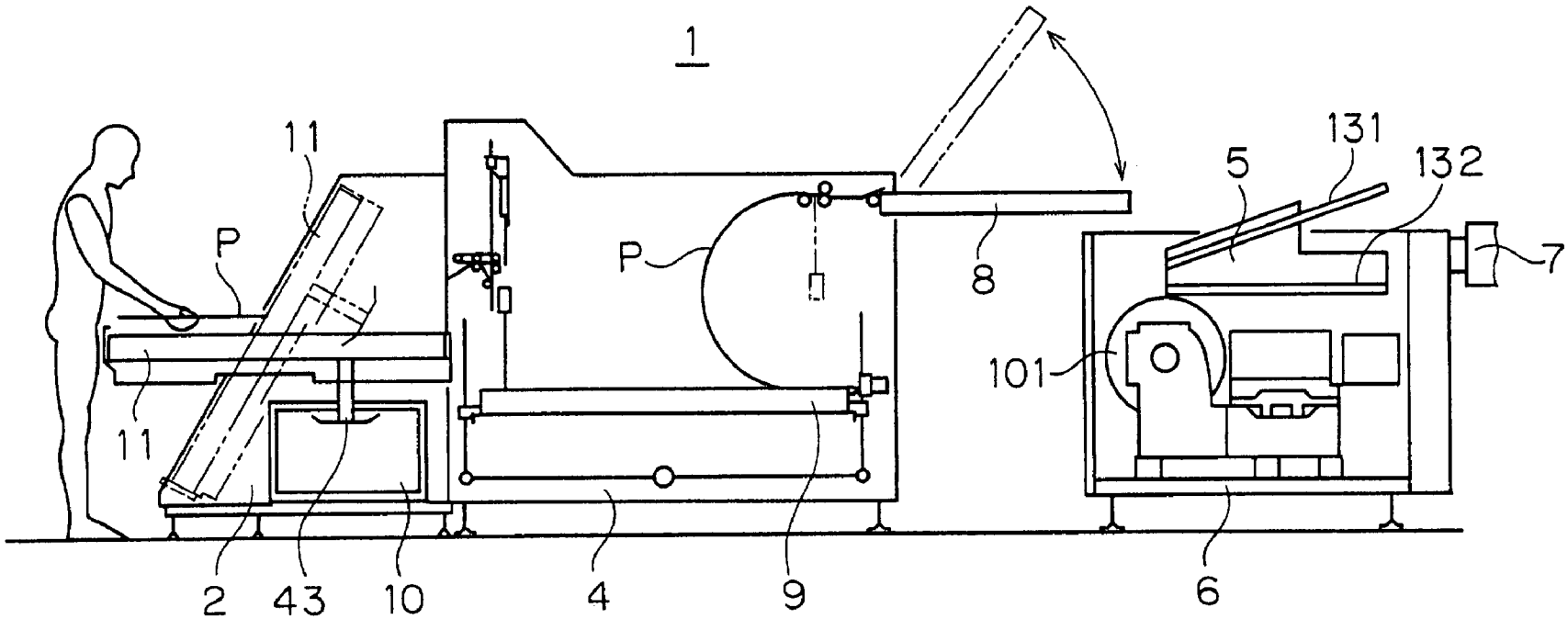
FIG. 2 is a schematic side view of the image recording system according to the present invention.
Figure 3:
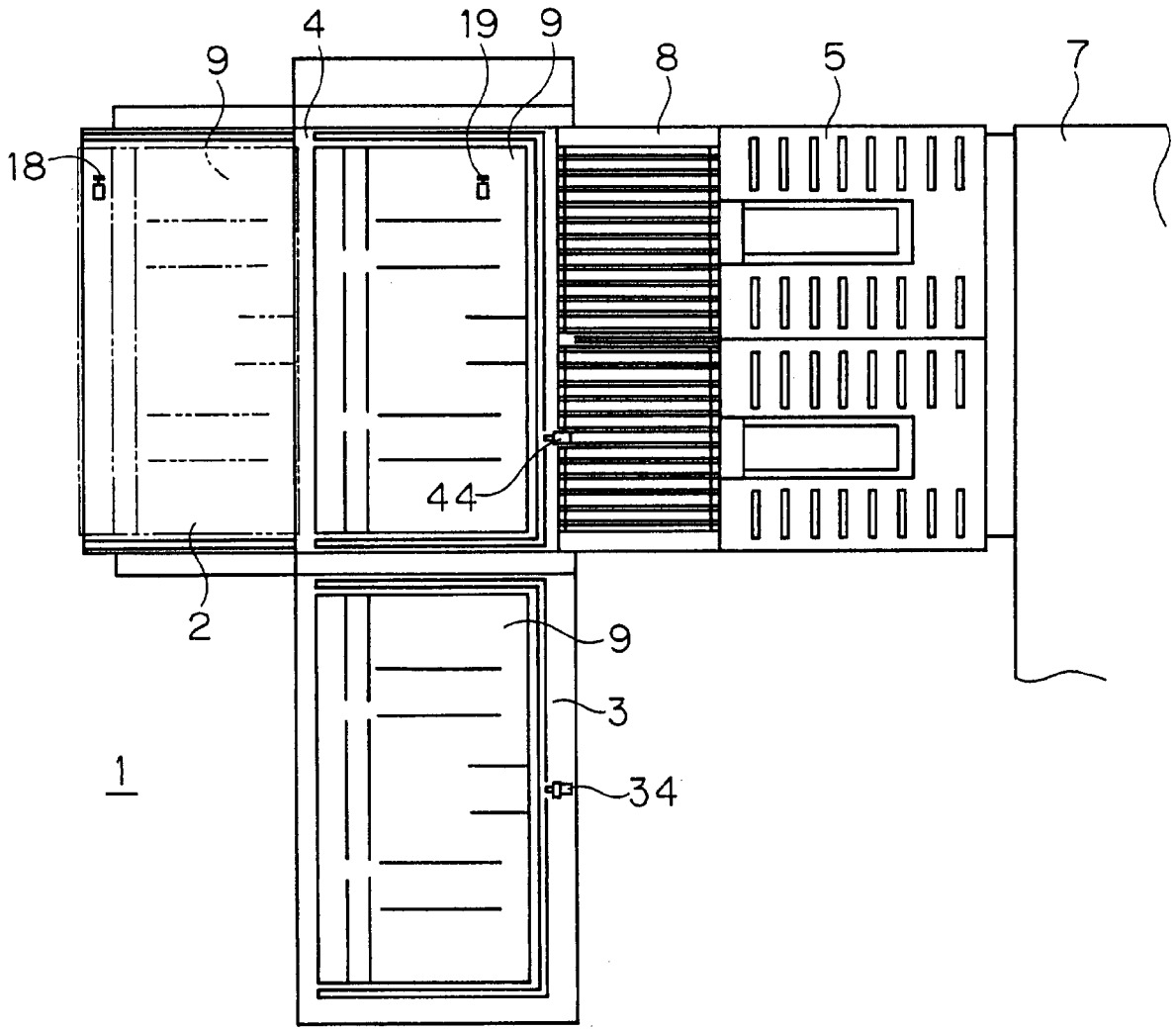
FIG. 3 is a schematic plan view of the image recording system according to the present invention.

A preferred embodiment according to the present invention will now be described with reference to the drawings. FIG. 1 is a perspective view of an image recording system 1 according to the present invention. FIG. 2 is a schematic side view of the image recording system 1, and FIG. 3 is a schematic plan view thereof.

The image recording system 1 comprises a plate storage part 2, a multi-cassette part 3, an autoloader part 4, a feed/discharge tray part 5, an image recording part 6, a transfer mechanism 7, and a conveyor part 8. The plate storage part 2 is used when storing plates P in a cassette 9. The multi-cassette part 3 holds a plurality of cassettes 9 arranged vertically in multiple tiers. The autoloader part 4 acts to remove a plate P out of a cassette 9 in a predetermined plate feed position. The feed/discharge tray part 5 has a plate feed tray 131 and a plate discharge tray 132, and is provided to transfer the plate P to and from the image recording part 6. The image recording part 6 acts to record a predetermined image on the plate P. The transfer mechanism 7 is provided to transfer the plate P on which the image is recorded by the image recording part 6 to an automatic developing apparatus in a subsequent stage.

The conveyor part 8 is intended to transport the plate P from the autoloader part 4 to the feed/discharge tray part 5. The conveyor part 8 is pivotable in flip-up fashion about one edge thereof as indicated by the dash-double-dot lines in FIG. 2 for improvement in maintenance of the entire part.

In the image recording system 1, the multi-cassette part 3 can store therein five cassettes 9 arranged vertically in tiers. For transport of a plate P in a cassette 9 to the image recording part 6, a slide mechanism to be described later moves the cassette 9 stored in the multi-cassette part 3 to the autoloader part 4. Then, a lifting mechanism to be described later vertically moves the cassette 9 to a plate feed position shown in FIG. 2.

For storage of a new plate P into a cassette 9, the slide mechanism to be described later first moves the cassette 9 stored in the multi-cassette part 3 to the autoloader part 4. Then, the lifting mechanism to be described later vertically moves the cassette 9 to a cassette take-out position level with a cassette receiver 11 in a horizontal position indicated by the solid lines in FIG. 2. Thereafter, the cassette 9 in the autoloader part 4 is driven by motors 18 and 19 shown in FIG. 3 to move along a guide member not shown into the cassette receiver 11 in the plate storage part 2.

Figure 4:
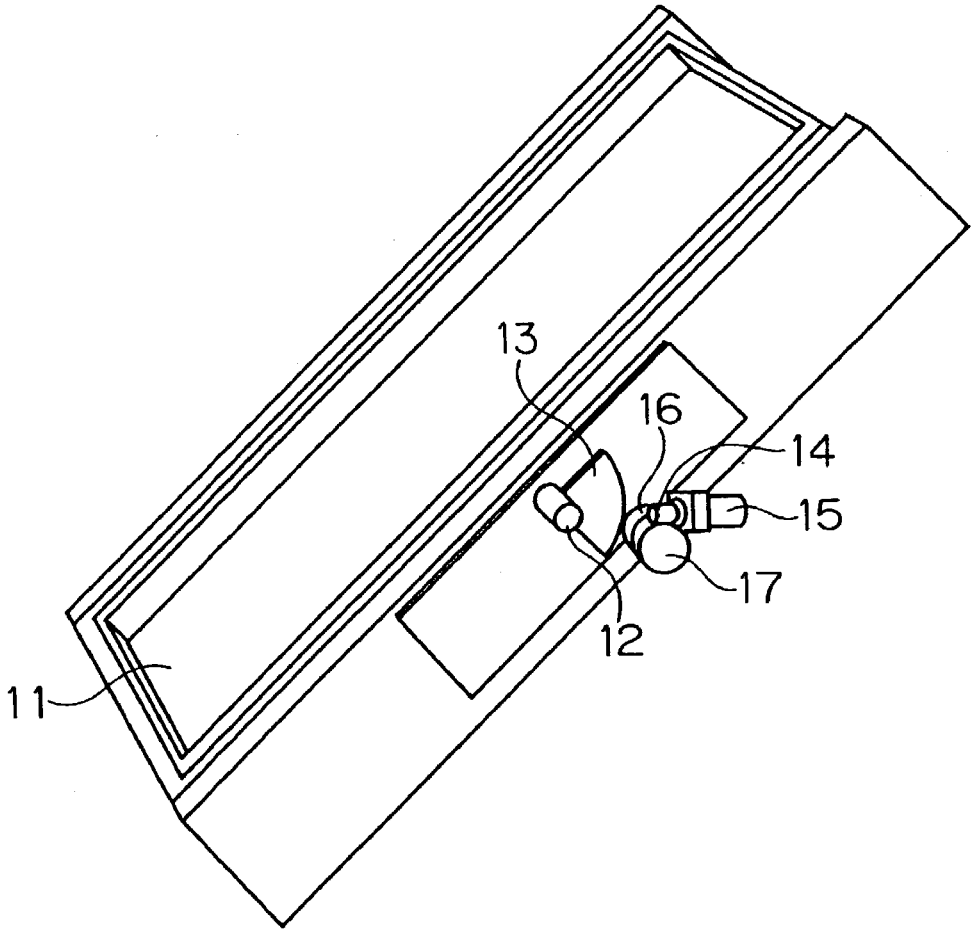
FIG. 4 is a perspective view of a pivotal mechanism in a cassette receiver.

FIG. 4 is a perspective view of a pivotal mechanism in the cassette receiver 11. The cassette receiver 11 includes a shaft 12, and is provided in the plate storage part 2 for pivotal movement about the shaft 12. A spur gear 13 whose central axis is the shaft 12 is provided on the outer periphery of the shaft 12. A motor 15 provided with a worm gear 14 is disposed in the plate storage part 2. The worm gear 14 is in meshing engagement with a worm wheel 17 coaxial with a spur gear 16 in meshing engagement with the spur gear 13. Thus, the cassette receiver 11 is driven by the motor 15 to pivot between the horizontal position indicated by the solid lines in FIG. 2 and an inclined position indicated in phantom in FIG. 2.

During the movement of the cassette 9 between the autoloader part 4 and the cassette receiver 11, the cassette receiver 11 assumes the horizontal position. For storage of the plate P into the cassette 9 moved in the cassette receiver 11, the cassette receiver 11 may remain assuming the horizontal position if the plate P is relatively small. For storage of the plate P which is relatively large into the cassette 9, the cassette receiver 11 assumes the inclined position. This allows the relatively large plate P to be easily stored into the cassette 9 without bending the plate P.

Figure 5:
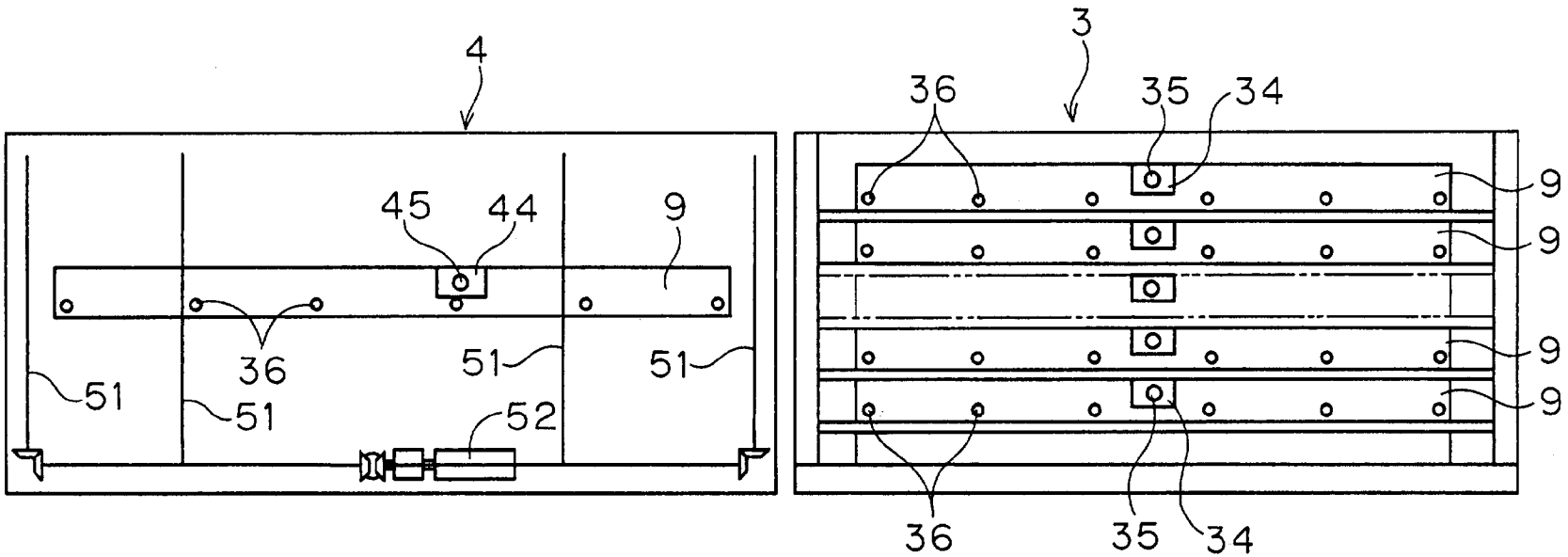
FIG. 5 is a side view showing the constructions of a slide mechanism extending from a multi-cassette part to an autoloader part and a lifting mechanism disposed in the autoloader part.
Figure 6:
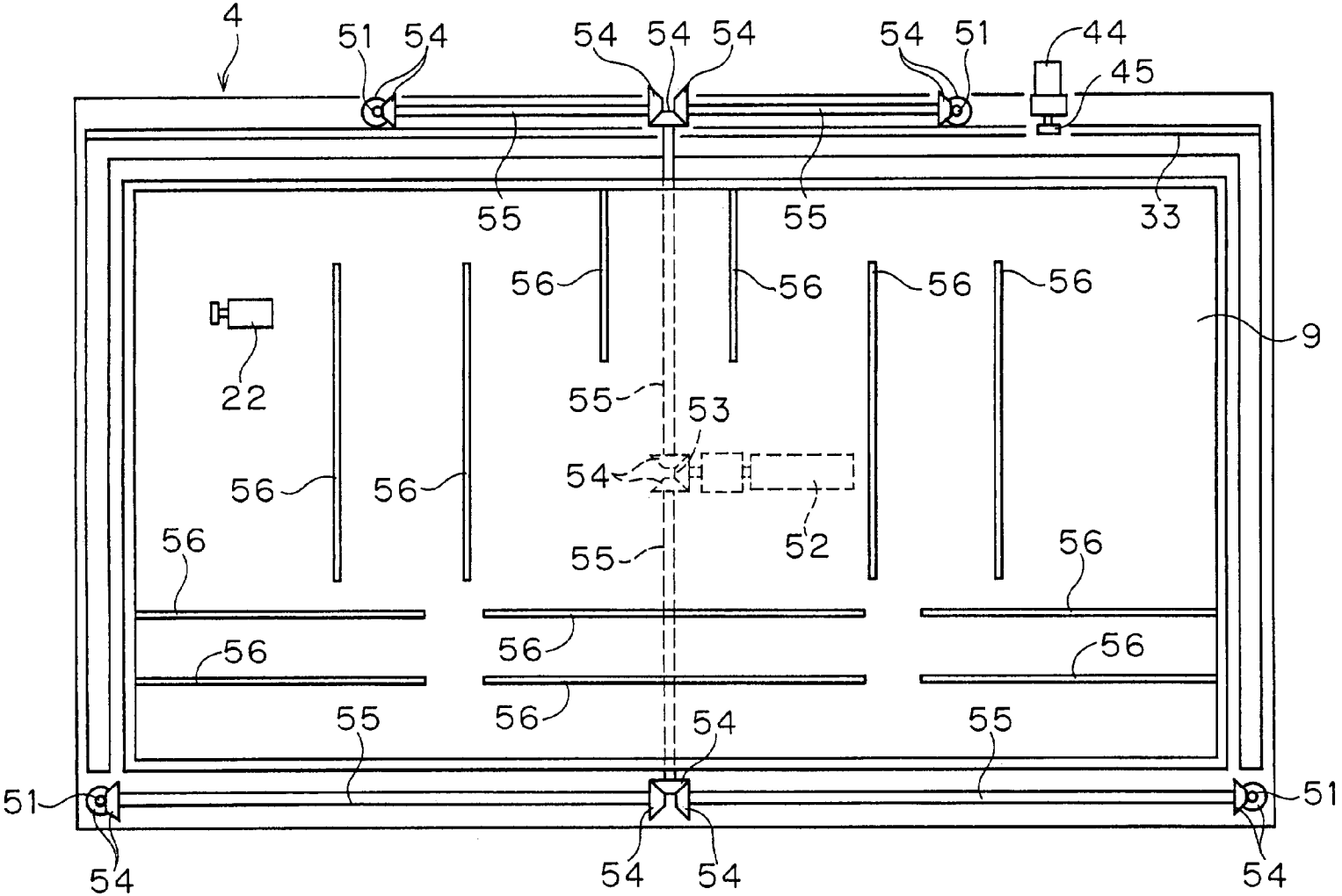
FIG. 6 is a plan view showing the construction of the lifting mechanism disposed in the autoloader part.
Figure 7:
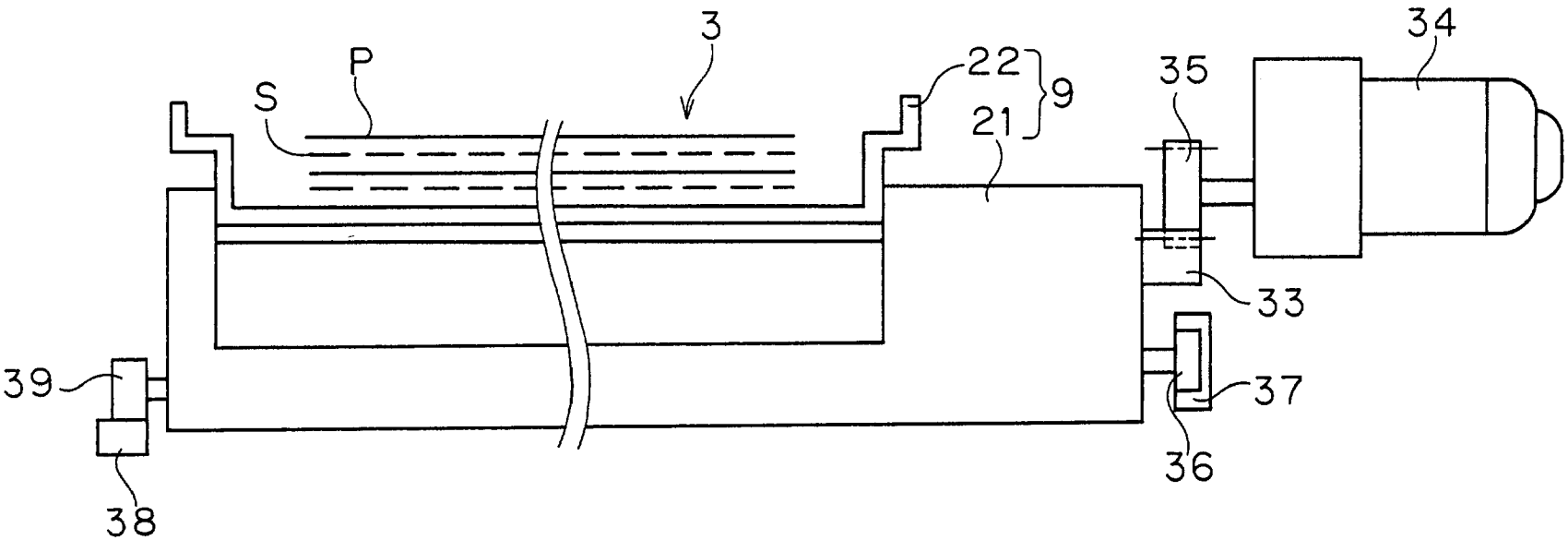
FIGS. 7 and 8 are enlarged views of principal parts showing a relationship between a cassette and the slide mechanism.
Figure 8:
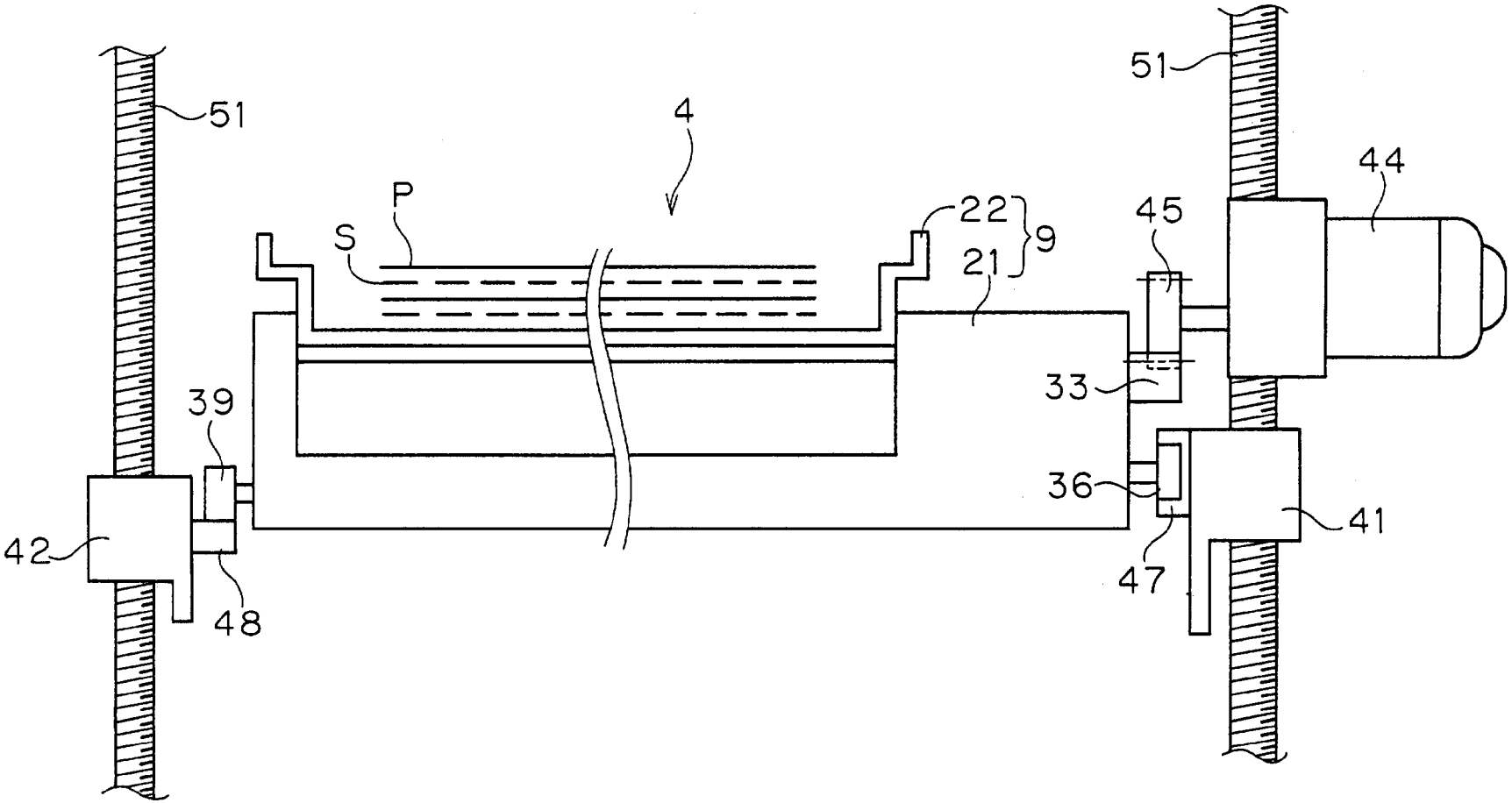

Next, the constructions of the slide mechanism for moving the cassette 9 between the multi-cassette part 3 and the autoloader part 4 and the lifting mechanism for vertically moving the cassette 9 in the autoloader part 4 will be described. FIG. 5 is a side view showing the constructions of the slide mechanism extending between the multi-cassette part 3 and the autoloader part 4 and the lifting mechanism disposed in the autoloader part 4. FIG. 6 is a plan view showing the construction of the lifting mechanism disposed in the autoloader part 4. FIGS. 7 and 8 are enlarged views of principal parts showing the relationship between the cassette 9 and the slide and lifting mechanisms. The relationship between the cassette 9 in the multi-cassette part 3 and the slide mechanism is shown in FIG. 7, and the relationship between the cassette 9 in the autoloader part 4 and the slide and lifting mechanisms is shown in FIG. 8.

The multi-cassette part 3 can store therein the cassettes 9 arranged vertically in five tiers, as shown in FIG. 5. Each of the cassettes 9 has an outer tray 21, and an inner tray 22 disposed inside the outer tray 21. A plurality of plates P and a plurality of interleaves S alternately vertically stacked are stored in the inner tray 22. Such a stack of plates P and interleaves S is referred to hereinafter as a plate-interleaf stack. As illustrated in FIG. 7, a rack 33 is attached to one outer side surface of the outer tray 21 of each of the cassettes 9. The rack 33 is in meshing engagement with a pinion 35 driven to rotate by a motor 34 secured to the multi-cassette part 3.

A plurality of rollers 36 for engagement with a guide member 37 provided in the multi-cassette part 3 are provided on the same outer side surface of the outer tray 21 of each cassette 9, as shown in FIG. 7. The guide member 37 is provided in corresponding relation to the location of each of the cassettes 9. In this preferred embodiment, five guide members 37 are provided. A plurality of rollers 39 supported by a support rail 38 provided in the multi-cassette part 3 are provided on the opposite outer side surface of the outer tray 21 of each cassette 9. The support rail 38 is also provided in corresponding relation to the location of each of the cassettes 9. In this preferred embodiment, five support rails 38 are provided.

When the pinion 35 is driven by the motor 34 to rotate, the rack 33 disposed on the outer tray 21 is forced by the pinion 35, whereby the entire cassette 9 is moved in the leftward and rightward directions as seen in FIGS. 5 and 6 (or in the direction perpendicular to the plane of FIG. 7). Thus, each cassette 9 moves horizontally between the multi-cassette part 3 and the autoloader part 4.

Referring to FIG. 8, the autoloader part 4 includes a guide member 47 similar to the guide members 37 of the multi-cassette part 3, and a support rail 48 similar to the support rails 38 of the multi-cassette part 3. A guide member bracket 41 and a support rail bracket 42 are attached to the guide member 47 and the support rail 48, respectively, and are in threaded engagement with respective ball screws 51. The autoloader part 4 further includes a motor 44 similar to the motor 34 of the multi-cassette part 3, and a pinion 45. The motor 44 is coupled through a coupling member not shown to the guide member bracket 41, and is vertically movable with the guide member bracket 41.

As illustrated in FIGS. 5 and 6, a motor 52 provided with a miter gear 53 about its rotary shaft is disposed in a lower central portion of the autoloader part 4. The miter gear 53 is coupled through a plurality of miter gears 54 and a plurality of shafts 55 to the ball screws 51 in threaded engagement with the guide member 47 and the support rail 48. Thus, the set of the guide member 47 and the guide member bracket 41, and the set of the support rail 48 and the support rail bracket 42 are respectively driven by the lifting motor 52 to move vertically.

The cassette 9 having been stored in the middle tier of the multi-cassette part 3 is shown in FIG. 5 as moved into the autoloader part 4. In such a position, the guide members 37 and 47 shown in FIGS. 7 and 8 are arranged in line with each other, and the support rails 38 and 48 are also in line with each other. The pinions 35 in the multi-cassette part 3 and the pinion 45 in the autoloader part 4 are placed on a level with each other and so that a distance therebetween is less than the length of the rack 33 attached to the cassette 9.

With such an arrangement, when the pinion 35 is driven by a corresponding motor 34 in the multi-cassette part 3 to rotate and the pinion 45 is driven by the motor 44 in the autoloader part 4 to rotate, the cassette 9 is initially driven at its rack 33 from the motor 34 through the pinion 35. Thus, the cassette 9 is guided by the guide member 37 and the support rail 38 in the multi-cassette part 3 to move from the multi-cassette part 3 toward the autoloader part 4.

When the leading edge of the cassette 9 enters the autoloader part 4, the cassette 9 is then guided by the guide member 47 and the support rail 48. Then, after the rack 33 of the cassette 9 comes into meshing engagement with the pinion 45 in the autoloader part 4 and is driven from the motor 44 through the pinion 45, the rack 33 is disengaged from the pinion 35 in the multi-cassette part 3.

After the disengagement of the rack 33 from the pinion 35, the cassette 9 is also driven from the motor 44 through the pinion 45 in the autoloader part 4 to move to the position shown in FIG. 5. Thereafter, the cassette 9 is driven by the lifting motor 52 to move vertically to the predetermined plate feed position or the cassette take-out position. The plate feed position refers to a position in which the plate P removed out of the cassette 9 is transported toward the image recording part 6, and the cassette take-out position refers to a position in which the cassette 9 is moved into the plate storage part 2.

The cassette 9 can hold therein a plurality of horizontally arranged plate-interleaf stacks including plates P of various sizes. To this end, the bottom of the cassette 9 is formed with grooves 56 for mounting therein positioning members 57 (See FIGS. 9A, 9B and 9C) for determining the holding position of the plate-interleaf stacks depending on the sizes of the plates P.

Figure 9A:
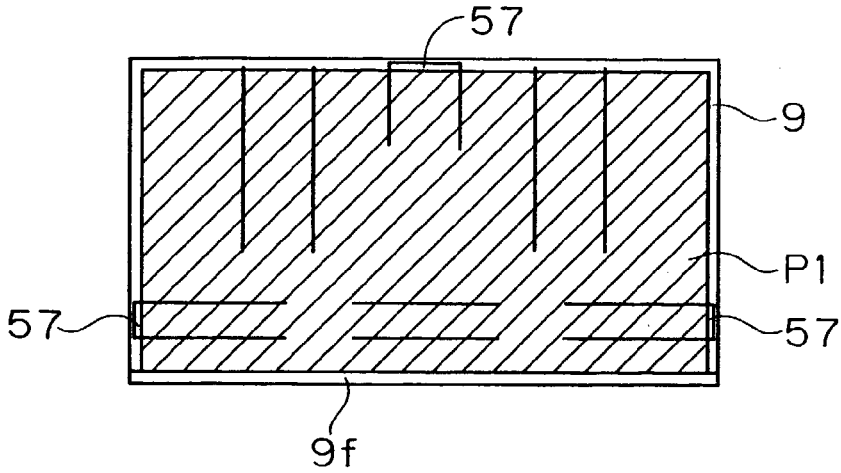
FIGS. 9A, 9B and 9C illustrate plates of various sizes held in the cassette.
Figure 9B:
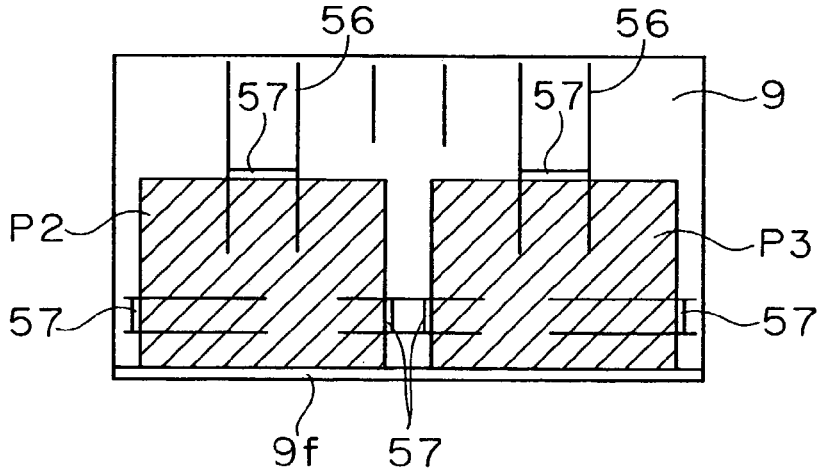
Figure 9C:
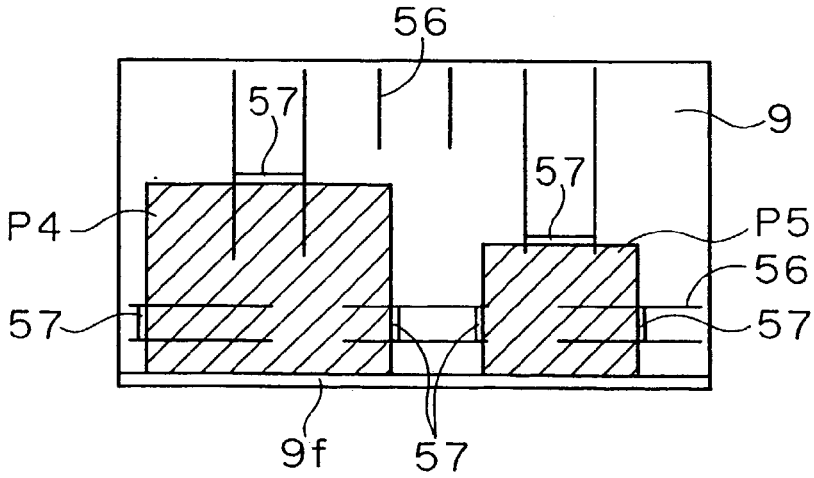

FIGS. 9A, 9B and 9C are top views of the cassette 9 in which plate-interleaf stacks including plates P of various sizes are held. With reference to FIGS. 9A, 9B, 9C and FIG. 10 (to be described later) showing a similar top view, the plate-interleaf stacks will be illustrated using their top plates P (P1 to P5) as a representative for purposes of simplification. FIG. 9A shows a relatively large plate P1 of single size held in the cassette 9. FIG. 9B shows plates P2 and P3 of the same size held in the cassette 9. FIG. 9C shows plates P4 and P5 of different sizes held in the cassette 9.

In any one of the cases shown in FIGS. 9A, 9B and 9C, the plate P held in the cassette 9 is positioned in such a manner that one edge of the plate P abuts against one inner wall 9*f* of the cassette 9 and the remaining three edges abut against the positioning members 57 mounted in the grooves 56.

Figure 10:
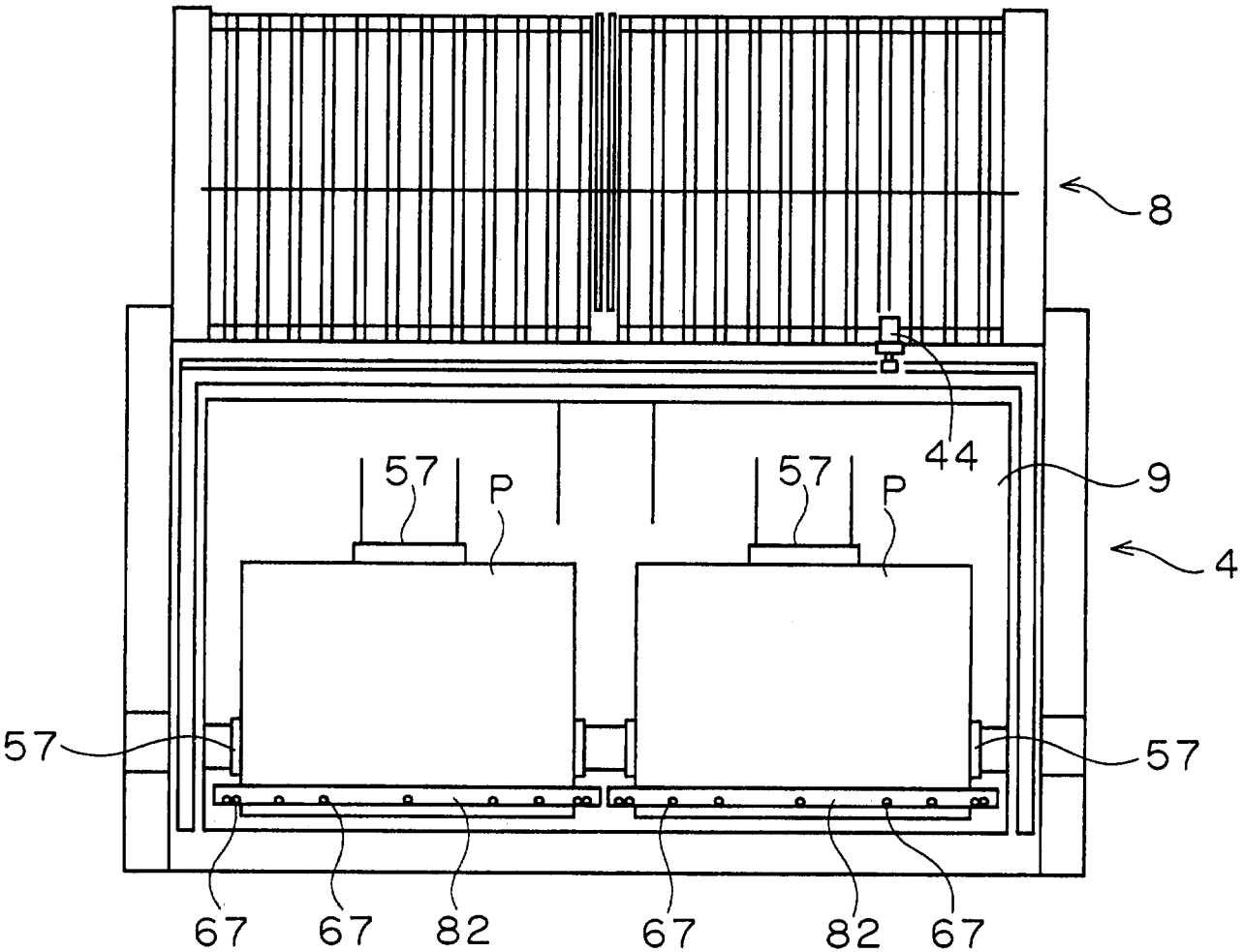
FIG. 10 is a plan view of the autoloader part with a conveyor part for illustration of a plate transport mechanism.
Figure 11:
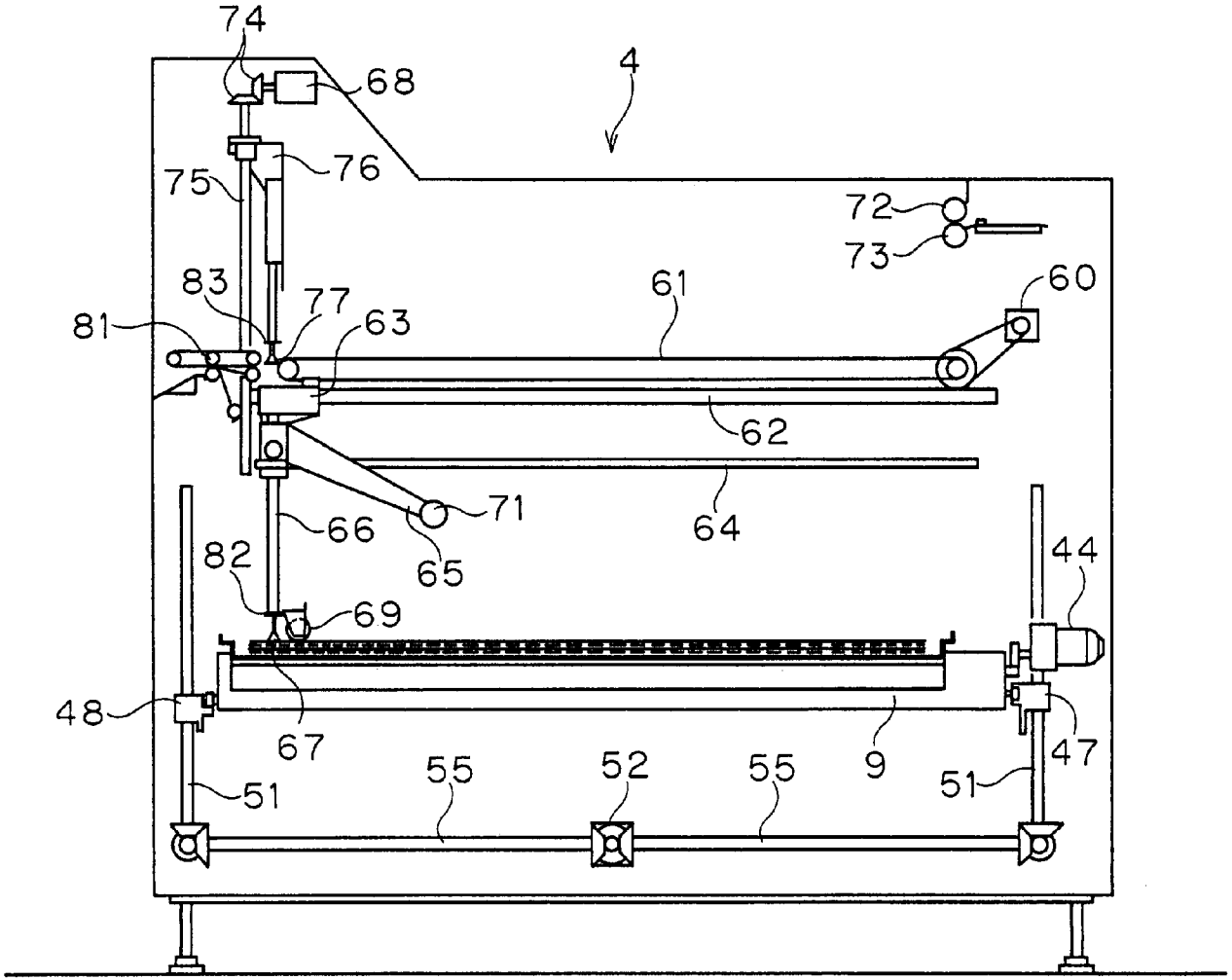
FIG. 11 is a view for illustrating the operations of the plate transport mechanism and an interleaf removal mechanism in the autoloader part.
Figure 15:
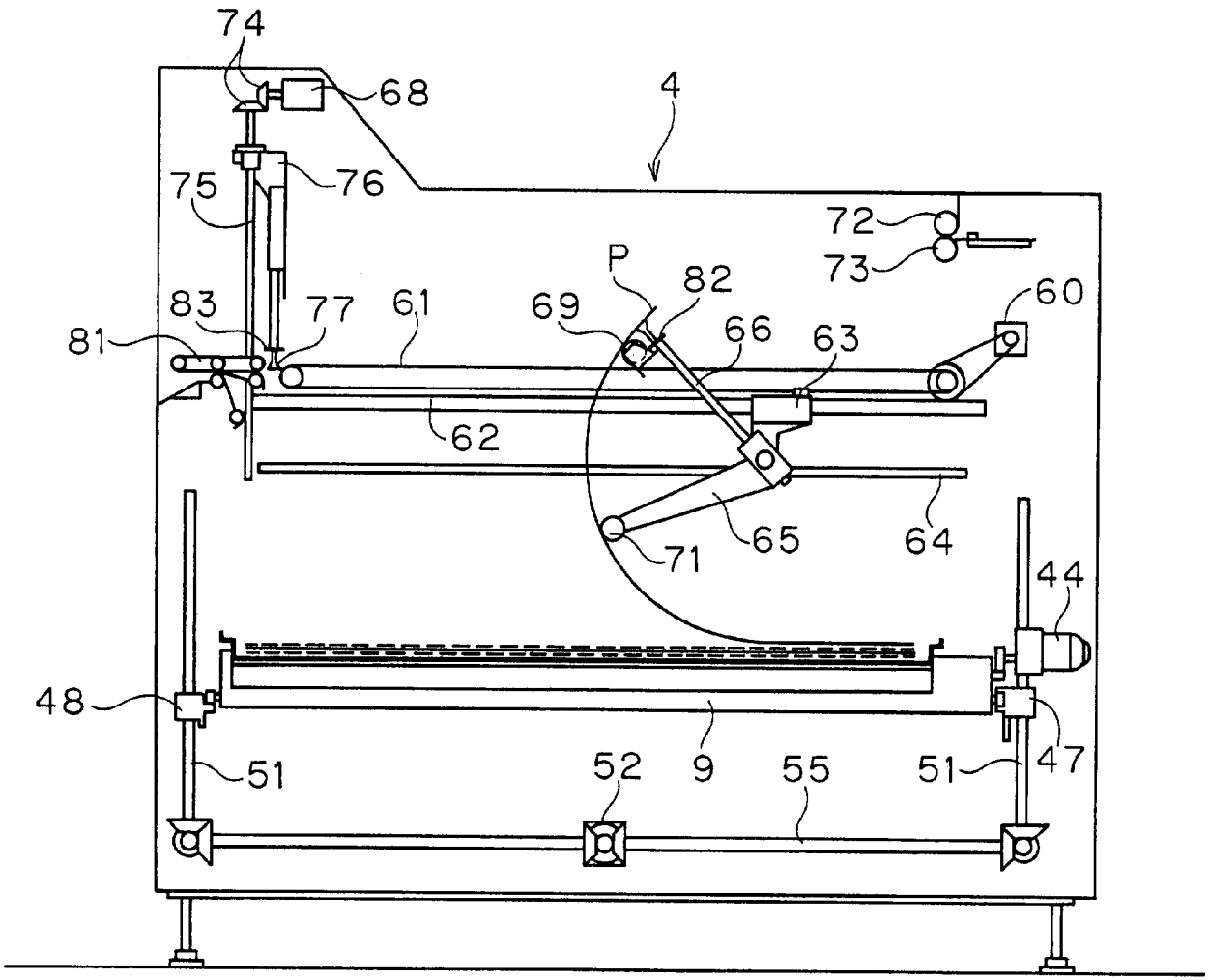
FIGS. 15 and 16 are views for illustrating the operations of the plate transport mechanism and the interleaf removal mechanism in the autoloader part.
Figure 16:
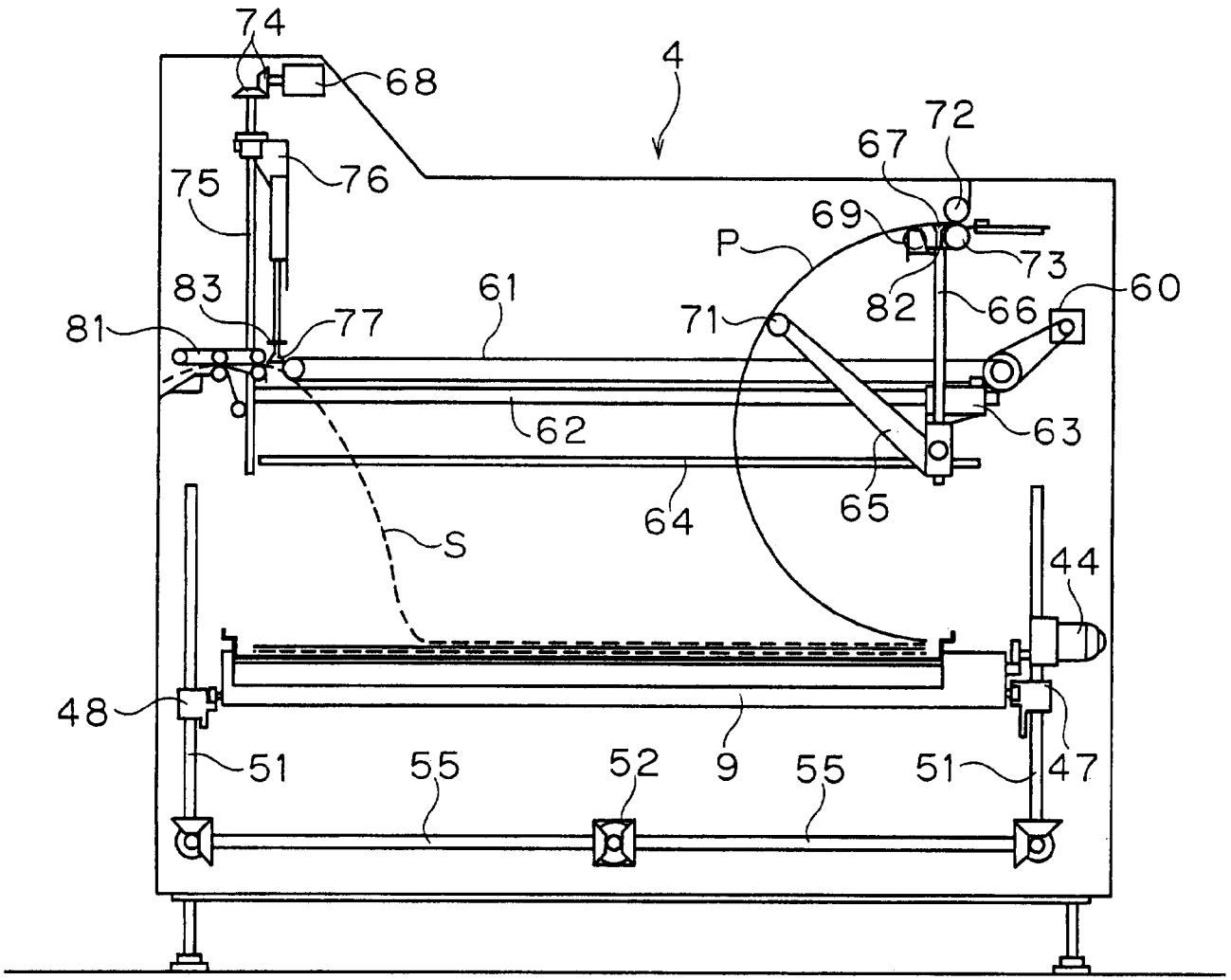

Next, the constructions of a plate transport mechanism for transporting a plate P from the cassette 9 in the plate feed position toward the conveyor part 8, and an interleaf removal mechanism for removing an interleaf S from between plates P in the cassette 9 will be described. FIG. 10 is a plan view showing the autoloader part 4 and the conveyor part 8 for illustration of the plate transport mechanism. FIGS. 11, 15 and 16 are views for illustrating the operations of the plate transport mechanism and the interleaf removal mechanism in the autoloader part 4.

The plate transport mechanism is intended to transport the plate P from the cassette 9 moved to the plate feed position toward the conveyor part 8. The plate transport mechanism principally comprises a motor 60, an endless synchronous belt 61 driven by the motor 60 to run around, and a traveling member 63 attached to the synchronous belt 61 for traveling along a guide rail 62. The traveling member 63 is provided with a pinion not shown for meshing engagement with a rack 64 extending in parallel with the guide rail 62, and an arm 66 is fixed to the pinion. A pair of support plates 82 to be described later are disposed on the forward end of the arm 66, and a plurality of suction pads 67 for holding the plate P under suction are attached to the support plates 82.

A support roller 69 is also disposed on the forward end of the arm 66. The support roller 69 supports a leading edge portion of the plate P from below during the transport of the plate P. An arm 65 is coupled to the arm 66. The arm 65 has a support roller 71 on its forward end. The support roller 71 supports a middle portion of the plate P from below during the transport of the plate P.

As illustrated in FIG. 10, the pair of support plates 82 are arranged in corresponding relation to two plates P held side by side in the cassette 9. The suction pads 67 attached to the support plates 82 are selectively used depending on the size of the plates P to be held under suction. The suction pads 67 are movable in a direction in which the suction pads 67 are arranged (or leftwardly and rightwardly as seen in FIG. 10) depending on the size of the plates P to be held under suction.

In the plate transport mechanism having such a construction, as the traveling member 63 is driven by the motor 60 to move rightwardly as seen in FIG. 11 from the position shown in FIG. 11, the arm 66 pivots about the axis of the pinion not shown. Thus, as the traveling member 63 is driven by the motor 60 to move rightwardly while the plate P is held under suction by the suction pads 67 (FIG. 11), the plate P held under suction by the suction pads 67 is flipped over (FIG. 15), and is then held at its leading edge between transport rollers 72 and 73 (FIG. 16). The transport rollers 72 and 73 are a pair of rollers for transporting the plate P toward the conveyor part 8.

The interleaf removal mechanism is intended to remove an interleaf from between the plates P. The interleaf removal mechanism principally comprises a motor 68, a pair of miter gears 74 for transmitting the driving force of the motor 68, a ball screw 75 driven from the motor 68 through the miter gears 74 to rotate, a lifting member 76 for moving vertically along the ball screw 75, and a support 83 attached to the forward end of the lifting member 76.

Figure 12:
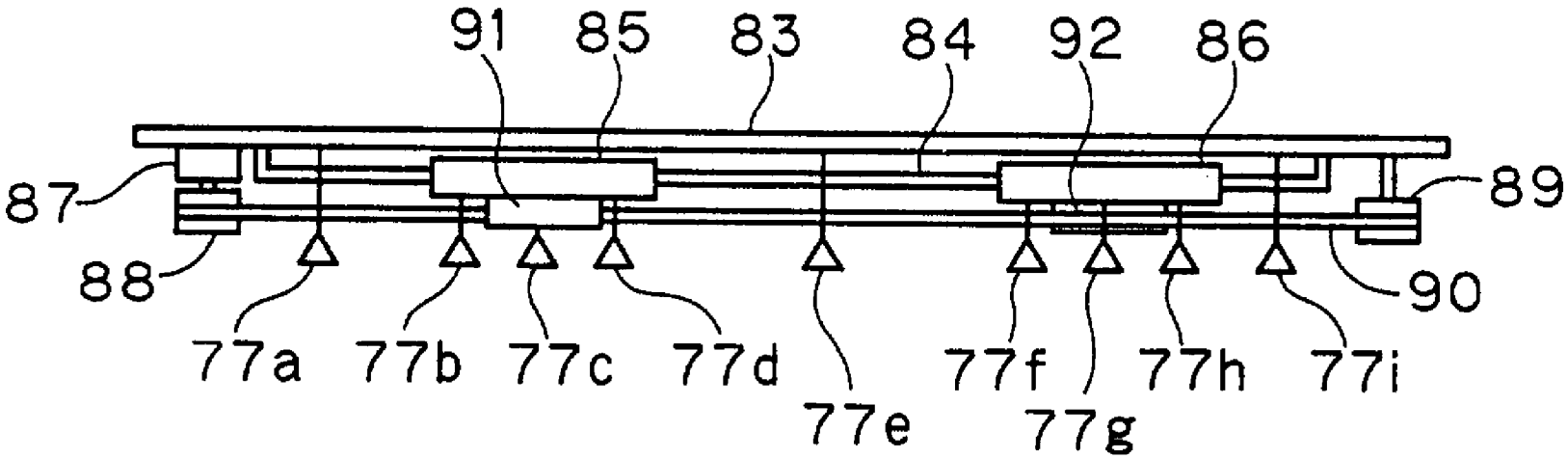
FIG. 12 is a view of an internal structure of a support for illustration of the construction of the interleaf removal mechanism.

The support 83 is a member in the form of plate having a bottom surface provided with suction pads (to be described later) acting as suction cups for holding and fixing the interleaf S under suction. FIG. 12 is a view for illustrating the arrangement of members with respect to the support 83 as viewed from the right hand side of FIG. 11. As shown in FIG. 12, a guide rail 84 is fixed to the bottom surface of the support 83. Two suction pad holding elements (a first suction pad holding element 85 and a second suction pad holding element 86) are mounted slidably in the rightward and leftward directions as viewed in FIG. 12 to the guide rail 84.

A motor 87 is attached to one end of the bottom surface of the support 83. The motor 87 is used to horizontally move the two suction pad holding elements 85 and 86 toward and away from each other. A pulley 88 is provided integrally with the driving shaft of the motor 87. A pulley 89 is provided on the opposite end of the support 83. A driving belt 90 is looped around and mounted on the pulleys 88 and 89, and is rotatably driven by the motor 87 rotating in normal and reverse directions.

Figure 13:
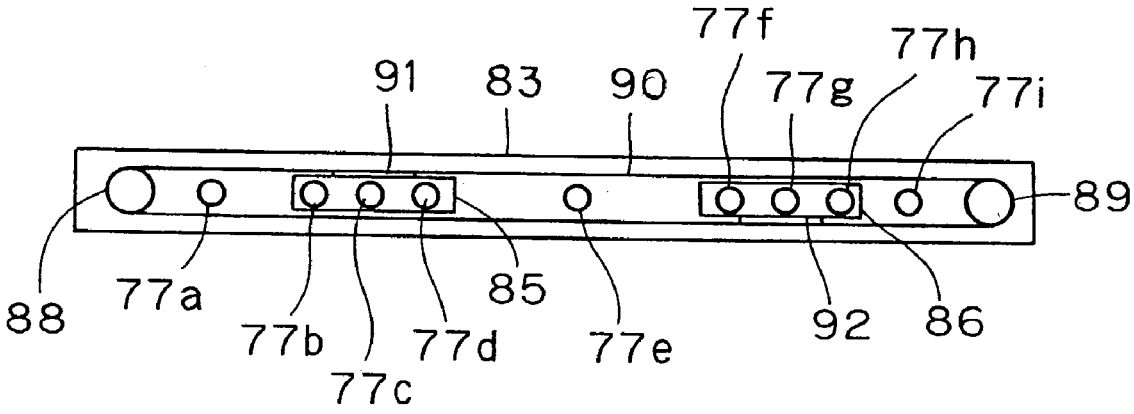
FIG. 13 is a bottom view of the support for illustration of the construction of the interleaf removal mechanism.

FIG. 13 is a bottom view of the support 83. As illustrated in FIG. 13, the first suction pad holding element 85 is coupled by a coupling member 91 to one of the opposed runs (or an upper run as viewed in FIG. 13) of the driving belt 90. The second suction pad holding element 86 is coupled by a coupling member 92 to the other run (or a lower run as viewed in FIG. 13) of the driving belt 90. Thus, as the motor 87 drives the driving belt 90 to run around in a clockwise direction as viewed in FIG. 13, the first and second suction pad holding elements 85 and 86 are moved toward each other. As the motor 87 drives the driving belt 90 to run around in a counterclockwise direction as viewed in FIG. 13, the first and second suction pad holding elements 85 and 86 are moved away from each other.

Suction pads 77*a* and 77*i* are disposed in opposite end portions of the support 83. A suction pad 77*e* is disposed in a longitudinally middle position of the support 83. These suction pads 77*a*, 77*e* and 77*i* are also referred to as fixed suction pads 77.

Three suction pads 77*b*, 77*c* and 77*d* are fixed on the bottom surface of the first suction pad holding element 85. Similarly, three suction pads 77*f*, 77*g* and 77*h* are fixed on the bottom surface of the second suction pad holding element 86. These six suction pads 77*b*, 77*c*, 77*d*, 77*f*, 77*g* and 77*h* are also referred to as movable suction pads 77.

The suction pads 77*a* to 77*i* are coupled to the same vacuum pump through a suction hose not shown. This allows the suction pads 77*a* to 77*i* to start the vacuum holding operation at the same time. A vacuum degree detection sensor is attached to some mid-portion of the suction hose. Depending on the degree of output from the vacuum degree detection sensor, a discrimination may be made among a plurality of states: a state in which nothing is vacuum-held by the suction pads 77; a state in which only an interleaf S is vacuum-held; a state in which only a plate P is vacuum-held; a state in which a plate P is attached to the back surface of an interleaf S; and a state in which a plurality of interleaves S are vacuum-held.

A switching valve or the like may be mounted to some mid-portion of the suction hose to effect individual control of the vacuum holding operations of the suction pads 77*a* to 77*i*.

As discussed with reference to FIGS. 9A through 9C, the cassette 9 can hold therein a relatively large plate-interleaf stack of single size or two plate-interleaf stacks of the same size or of different sizes. The interleaf removal mechanism according to the present invention, which includes the two sets of three movable suction pads 77*b*, 77*c* and 77*d*, and 77*f*, 77*g* and 77*h* movable in a direction perpendicular to the feed direction of the plate P, can perform a vacuum holding operation which quickly responds to changes, if any, in types and sizes of the plates P.

For instance, if a single plate-interleaf stack including plates P of a relatively small size is held in the cassette 9, the motor 87 is rotated in the clockwise direction as viewed in FIG. 13 to move the first and second suction pad holding elements 85 and 86 toward the middle of the support 83 for adaptation to the size of the plates P. On the other hand, if plates P of a relatively large size are held in the cassette 9 as shown in FIG. 9A, the first and second suction pad holding elements 85 and 86 are moved toward the opposite ends of the support 83.

If two plate-interleaf stacks are held side by side in the cassette 9 as shown in FIGS. 9B and 9C, the first and second suction pad holding elements 85 and 86 are moved so that the suction pads 77 in the middle of the respective suction pad holding elements 85 and 86, i.e. the suction pads 77*c* and 77*g*, come into the middle of the plates P of the respective stacks.

As shown in FIG. 11, when the suction pads 67 in the plate transport mechanism start holding the plate P under suction, the lifting member 76 in the interleaf removal mechanism is on standby in a raised position within its vertically movable range. Thereafter, the lifting member 76 starts moving downwardly when the leading edge of the plate P held by the suction pads 67 under suction is transported toward the pair of transport rollers 72 and 73.

Figure 14A:
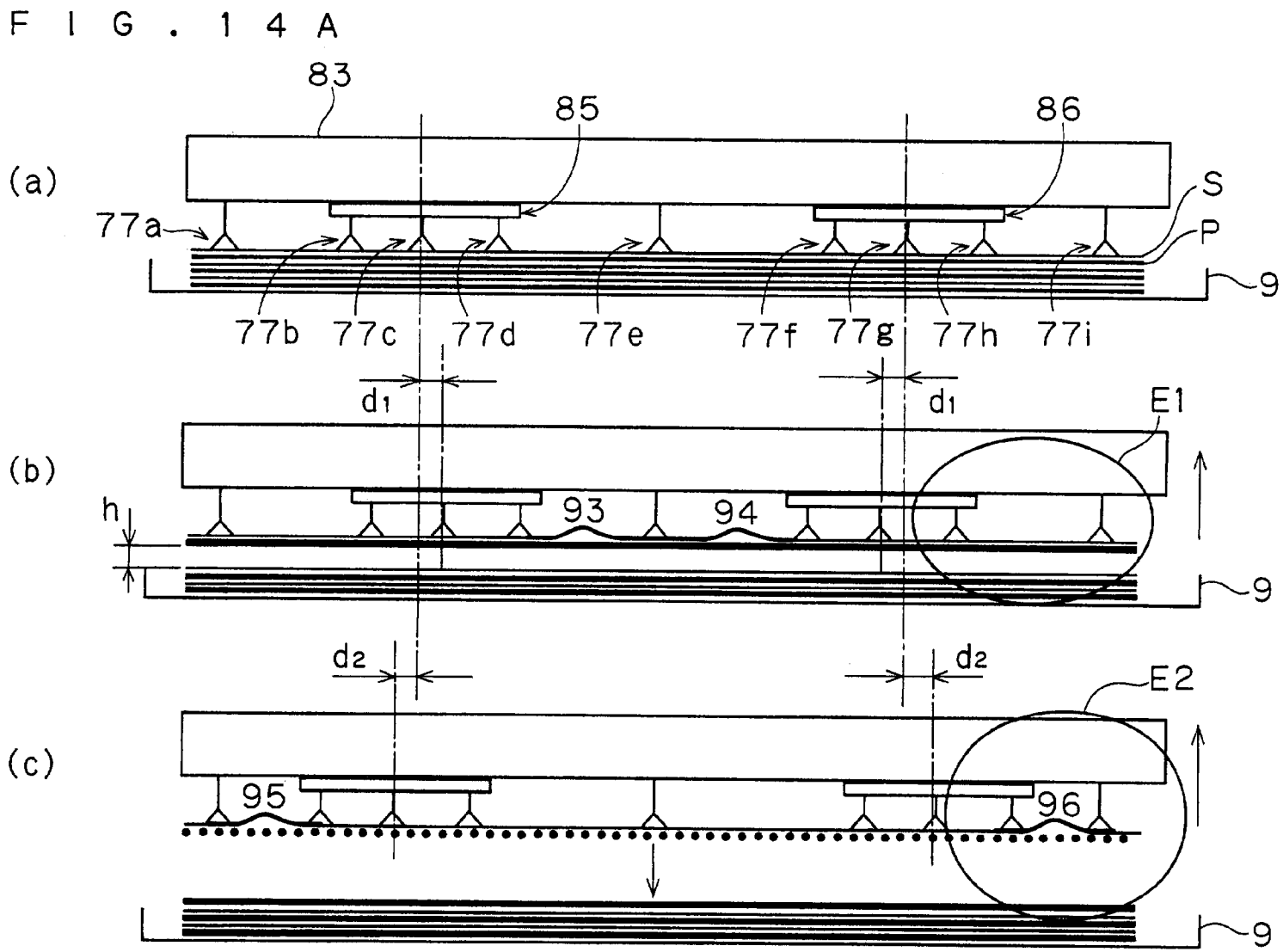
FIGS. 14A(a), 14A(b), 14A(c), and 14B are views for illustrating the operation of the interleaf removal mechanism.
Figure 14B:
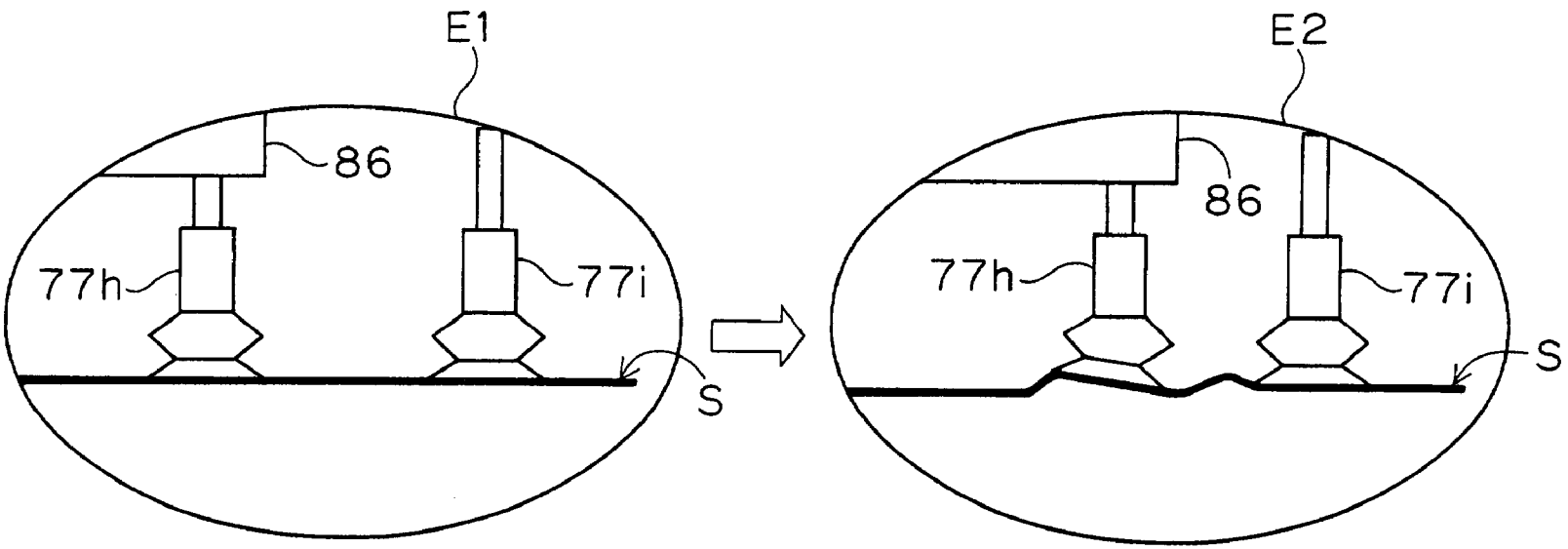

FIGS. 14A and 14B are views for illustrating the interleaf removal operation by means of the suction pads 77*a* to 77*i* in detail.

The support 83 and the suction pads 77*a* to 77*i* are shown at (a) in FIG. 14A as moved downward as the lifting member 76 is moved downward. The lifting member 76 is moved downward to a position in which the suction pads 77*a* to 77*i* can hold the top interleaf S in the cassette 9 under suction. The interleaf S is vacuum-held by the suction pads 77 under the action of the aforementioned vacuum pump.

The image recording system 1 according to the present invention is capable of mounting two plates P on the outer peripheral surface of a recording drum in such a manner that the two plates P are arranged in the axial direction of the drum, which will be described later. The cassette 9 accordingly can hold two plate-interleaf stacks therein as described above. In general, the two plate-interleaf stacks, which are used with equal frequency, are approximately equal in height to each other in the cassette 9. If one of the two stacks is used with higher frequency than the other for some reason, there arises a certain difference in height between the two stacks. As discussed above, the downward movement of the lifting member 76 is controlled so that the suction pads 77*a* to 77*i* stop at a vertical position adapted to the stack from which the interleaf S is intended to be removed.

When one of the two stacks from which the interleaf S is intended to be removed is lower in height than the other stack, the suction pads 77 are pressed more heavily against the top interleaf S of the other stack, which might damage the plate P. To prevent this, it is desirable that the suction pads 77 have sufficient flexibility.

After the interleaf S is held by the suction pads 77 under suction, the lifting member 76 moves upwardly to move the support 83 upwardly a predetermined distance h. If the interleaf S has high air permeability, the suction pads 77 sometimes also attract the plate P underlying the interleaf S under suction, with the interleaf S between the suction pads 77 and the plate P. If the interleaf S has no air permeability, the plate P is sometimes attached to the back surface of the interleaf S through electrostatic forces. In either case, further upward movement of the interleaf S with the plate P attached thereto might cause jamming or damages to plates P rubbing against each other in the cassette 9.

Whether or not the plate P is attached to the back surface of the interleaf S lifted by the suction pads 77 is distinguished by a change in output from the vacuum degree detection sensor during the time interval that the suction pads 77 move upwardly the distance h from the vertical position indicated at (a) to a vertical position indicated at (b). In proper operation, the degree of vacuum in a suction circuit should decrease abruptly while the suction pads 77 move upwardly from the vertical position indicated at (a) to the vertical position indicated at (b). If the plate P is attached to the back surface of the lifted interleaf S, the degree of vacuum does not sufficiently decrease. Such a difference in degree of vacuum may be used to detect the attachment of the plate P.

If it is judged that the plate P is attached to the back surface of the interleaf S, the six movable suction pads 77*b*, 77*c*, 77*d*, 77*f*, 77*g* and 77*i* among the suction pads 77*a* to 77*i* are reciprocated horizontally to drop the plate P into the cassette 9.

Specifically, both of the first and second suction pad holding elements 85 and 86 are moved horizontally a predetermined distance dl (e.g., 5 millimeters from the initial position indicated at (a)) toward the middle of the support 83, as indicated at (b). This moves the movable suction pads 77*b*, 77*c* and 77*d* horizontally toward the fixed suction pad 77*e*, and moves the movable suction pads 77*f*, 77*g* and 77*h* horizontally toward the fixed suction pad 77*e* at the same time. A portion E1 indicated at (b) is shown on an enlarged scale in FIG. 14B.

Because of the difference in flexural rigidity between the interleaf S and the plate P, the above-mentioned horizontal movement of the suction pads 77 produces an air layer 93 between the interleaf S and the plate P in a region defined between the movable suction pad 77*d* and the fixed suction pad 77*e*. Similarly, an air layer 94 is formed in a region defined between the movable suction pad 77*f* and the fixed suction pad 77*e*.

Next, the suction pad holding elements 85 and 86 are moved horizontally a predetermined distance d2 (e.g., 5 millimeters from the initial position indicated at (a)) away from each other, as indicated at (c). This produces an air layer 95 in a region defined between the fixed suction pad 77*a* and the movable suction pad 77*b*, and an air layer 96 in a region defined between the fixed suction pad 77*i* and the movable suction pad 77*h*.

Since the holding portions of the suction pads 77 are made of a flexible material as described above, the forward end portions of the suction pads 77 are suitably deformed so that the air layer 96 is formed well in a portion E2 shown on an enlarged scale in FIG. 14B.

Once the air layers 93 to 96 are formed between the interleaf S and the plate P, the plate P attached to the back surface of the interleaf S becomes easier to drop into the cassette 9 under its own weight. The distance h is so established that the vertical position of the suction pad holding elements 85 and 86 during the horizontal movement is low enough to prevent the plate P from being damaged when dropped.

Whether or not the plate P is separated from the interleaf S to drop into the cassette 9 is distinguished by monitoring a change in output from the vacuum degree detection sensor. The above-mentioned movement of the suction pad holding elements 85 and 86 toward and away from each other is repeated until it is judged that the plate P is separated from the interleaf S.

Thereafter, the suction pads 77 and the support 83 holding the leading edge portion of the interleaf S under suction are moved upwardly as the lifting member 76 moves upwardly. The lifting member 76 guides an edge of the one or two interleaves S held by the suction pads 77 under suction to an interleaf transport mechanism 81 to be described next, and then returns to the raised position within its vertically movable range as shown in FIG. 16.

The interleaf transport mechanism 81 is intended to remove the one or two interleaves S held by the suction pads 77 under suction into an interleaf collection box 10 (See FIGS. 1 and 2). The interleaf transport mechanism 81 is provided near the raised position of the suction pads 77*a* to 77*i* within the range of vertical movement caused by the vertical movement of the lifting member 76. The interleaves S removed into the interleaf collection box 10 is pressed by an interleaf presser 43 mounted on the back surface of the cassette receiver 11 to have a reduced volume, as shown in FIG. 2.

Figure 17:
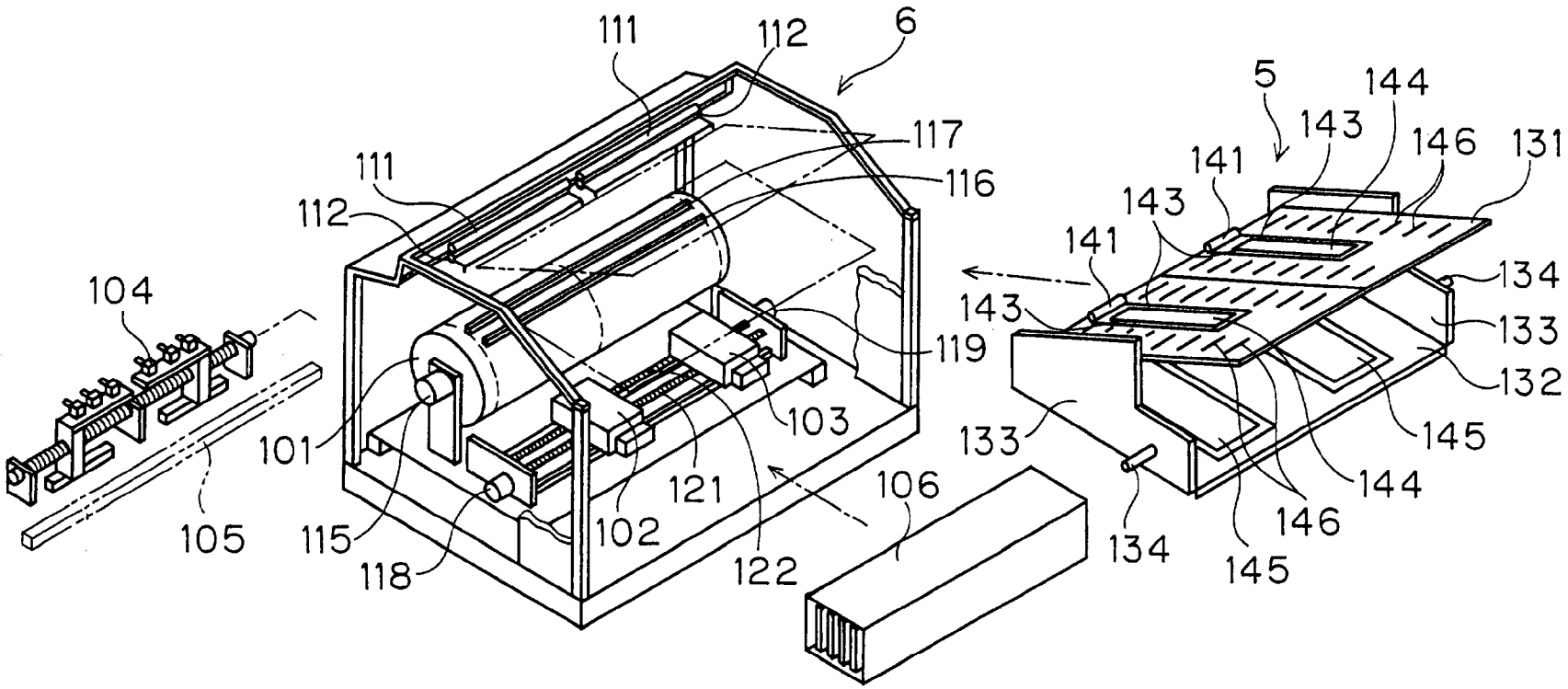
FIG. 17 is an exploded perspective view of an image recording part and a feed/discharge tray part.

Next, the constructions of the image recording part 6 and the feed/discharge tray part 5 will be described. FIG. 17 is an exploded perspective view of the image recording part 6 and the feed/discharge tray part 5.

First, the construction of the image recording part 6 will be described with reference to FIG. 17. The image recording part 6 comprises a cylindrical recording drum 101, a pair of recording heads 102 and 103, a punch unit 104, a side-to-side adjustment unit 105, and an electrical unit 106. The image recording part 6 includes two pairs of transport rollers 111 and 112 for guiding one or two plates P transported from the conveyor part 8.

The cylindrical recording drum 101 is intended to mount one or two plates P on the outer periphery thereof. The recording drum 101 is driven by a motor 115 to rotate about a horizontal axis. A leading edge clamp 116 for fixing the leading edge of the one or two plates P and a trailing edge clamp 117 for fixing the trailing edge of the one or two plates P are disposed on the outer periphery of the recording drum 101. A plurality of positioning pins (not shown) for engagement with pin holes formed in the leading edge portion of the one or two plates P are provided upright on the outer peripheral surface of the recording drum 101.

The pair of recording heads 102 and 103 are intended to record an image on the one or two plates P mounted on the outer periphery of the recording drum 101. The recording heads 102 and 103 include a multiplicity of light emitting devices not shown for directing optical beams modulated in accordance with an image signal onto the one or two plates P. The recording head 102 is driven by a ball screw 121 rotated by a motor 118 to move in a direction parallel to the axis of the recording drum 101. The recording head 103 is driven by a ball screw 122 rotated by a motor 119 to move in a direction parallel to the axis of the recording drum 101.

The punch unit 104 is intended to punch the leading edge portion of the one or two plates P to form a positioning pin hole or a pin hole serving as a reference during the use of the one or two plates P in a subsequent process before the one or two plates P are mounted on the outer periphery of the recording drum 101. The side-to-side adjustment unit 105 is intended to position the one or two plates P in a direction perpendicular to the feed direction thereof before the punch unit 104 punches the pin holes in the leading edge portion of the one or two plates P.

Next, the construction of the feed/discharge tray part 5 will be described with reference to FIG. 17 and FIGS. 18A, 18B, 19A, 19B, 20A, 20B, 21A, 21B, 22A and 22B which illustrate the operation of transporting a plate P. The feed/discharge tray part 5 includes the inclined plate feed tray 131 for temporarily placing thereon the plate P transported from the conveyor part 8 to guide the plate P to the image recording part 6, and the inclined plate discharge tray 132 for discharging the plate P on which the image is recorded by the image recording part 6 to the transfer mechanism 7 in a subsequent stage.

The plate feed tray 131 and the plate discharge tray 132 are coupled to each other by a pair of side panels 133, and are pivotable about a pair of shafts 134 mounted upright on the respective side panels 133 in synchronism with each other. The pair of shafts 134 are coupled to a rotary mechanism not shown. Control of the angular position of the shafts 134 enables the plate feed tray 131 and the plate discharge tray 132 to assume three angular positions: a first angular position assumed when placing the plate P from the conveyor part 8 onto the plate feed tray 131; a second angular position assumed when feeding the plate P to the punch unit 104 and the side-to-side adjustment unit 105; and a third angular position assumed when feeding the plate P punched with the pin holes to the recording drum 101.

A pair of transport rollers 141 and a pair of transport rollers 142 for transporting the plate P are provided on the lower edge of the plate feed tray 131. Suction cups 143 for vacuum-holding the lower surface of the plate P placed on the plate feed tray 131 to transport the plate P, and endless belts 144 for contacting the lower surface of the plate P placed on the plate feed tray 131 to transport the plate P are provided in openings formed in the plate feed tray 131. The suction cups 143 and the endless belts 144 move in synchronism with each other. A multiplicity of rollers 146 for contacting the lower surface of the plate P placed on the plate feed tray 131 to guide the plate P are provided on the surface of the plate feed tray 131.

Endless belts 145 for transporting the plate P placed on the plate discharge tray 132 are provided in openings formed in the plate discharge tray 132.

The above-mentioned plate feed tray 131 is sized to enable a plate P having a maximum size to be placed thereon. The inclined configuration of the plate feed tray 131 allows the reduction in footprint of the plate feed tray 131 if the plate feed tray 131 is increased in size.

In this preferred embodiment, the vertically stacked structure of the plate feed tray 131 and the plate discharge tray 132 achieves the reduction in footprint of the image recording part 6. Additionally, the plate feed tray 131 has a so-called switchback configuration in which the plate P having entered the plate feed tray 131 by way of the lower edge thereof is transported in the opposite direction again by way of the lower edge thereof to the image recording part 6. This reduces the height of the image recording part 6. Further, the pair of recording heads 102 and 103 may be located under the plate feed tray 131.

With reference to FIGS. 18A, 18B, 19A, 19B, 20A, 20B, 21A, 21B, 22A and 22B, description will be given on the operations of transporting to the image recording part 6 a plate P prior to image recording which is transported from the autoloader part 4 through the conveyor part 8 to the feed/discharge tray part 5, and of discharging the plate P after the image recording to the transfer mechanism 7 in the subsequent stage.

Figure 18A:
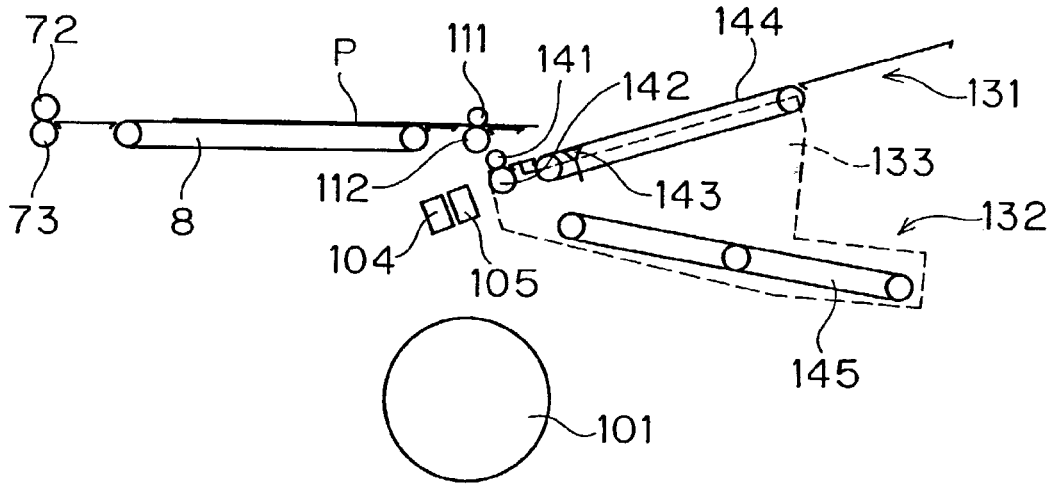
FIGS. 18A, 18B, 19A, 19B, 20A, 20B, 21A, 21B, 22A and 22B are views for illustrating a plate transport operation.
Figure 18B:
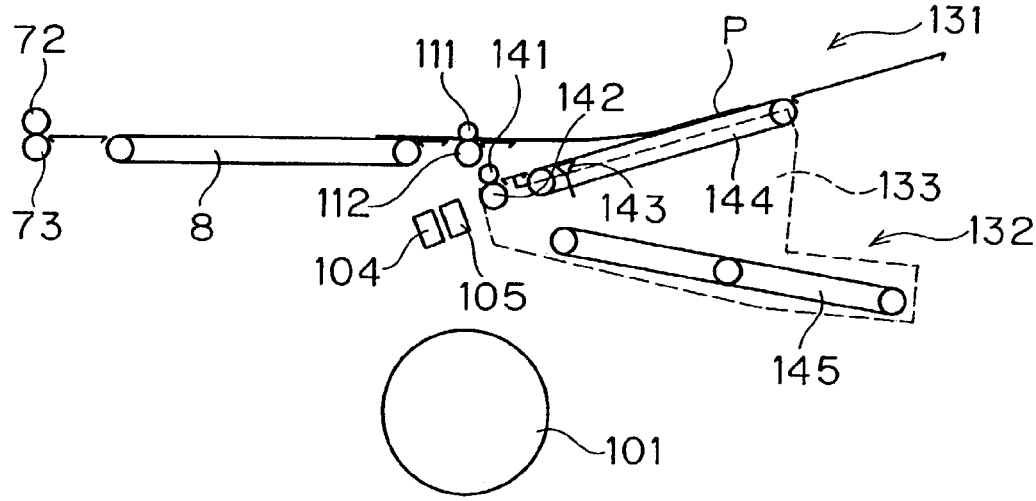

When the conveyor part 8 transports a first plate P taken out of the cassette 9 in the above-mentioned autoloader part 4, the plate feed tray 131 and the plate discharge tray 132 in the feed/discharge tray part 5 are in the first angular position shown in FIG. 18A. Then, when the leading edge of the first plate P is transferred from the conveyor part 8 onto the endless belt 144 as shown in FIG. 18B, the first plate P is driven for transport by both of the conveyor part 8 and the endless belt 144.

Figure 19A:
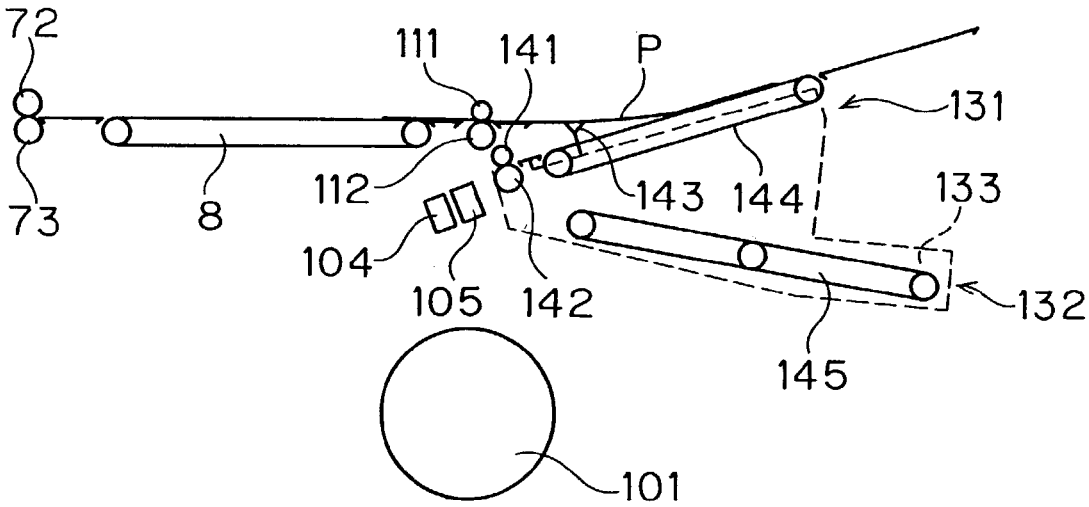
Figure 19B:
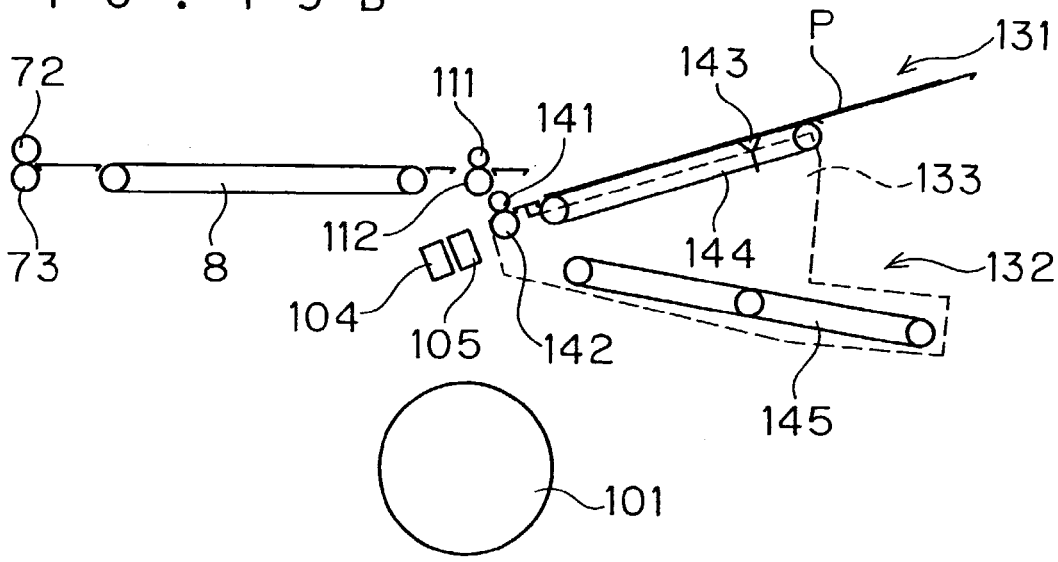

When the trailing edge of the first plate P comes near the forward end of the conveyor part 8, the suction cup 143 moves upward to vacuum-hold the lower surface of the first plate P, as shown in FIG. 19A. In this condition, the endless belt 144 and the suction cup 143 move in synchronism with each other to place the first plate P on the plate feed tray 131, as shown in FIG. 19B.

Figure 20A:
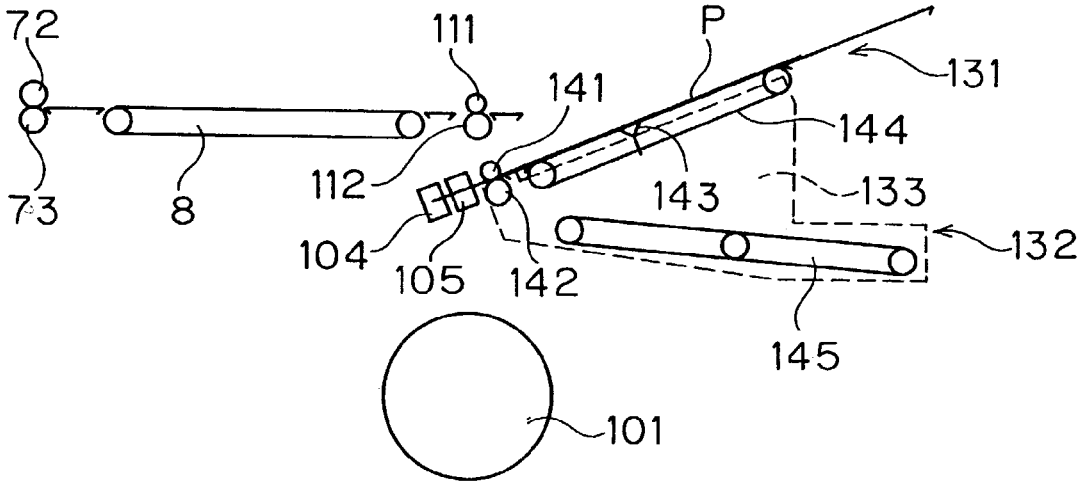

Next, the plate feed tray 131 and the plate discharge tray 132 are placed in the second angular position, as shown in FIG. 20A. The leading edge of the first plate P is inserted into the side-to-side adjustment unit 105 and the punch unit 104 which in turn carry out the positioning and pin hole punching, respectively, on the first plate P.

Figure 20B:
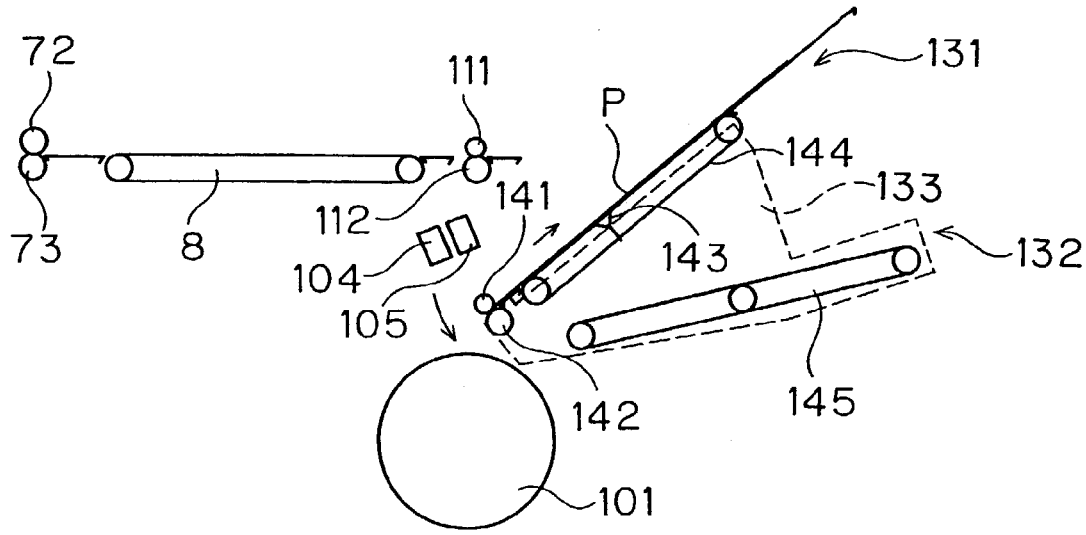

After the first plate P is positioned and punched with the pin hole, the first plate P is transported to a position in which the leading edge thereof is held between the pair of transport rollers 141 and 142 as shown in FIG. 20B, and the plate feed tray 131 and the plate discharge tray 132 in the feed/discharge tray part 5 are placed in the third angular position shown in FIG. 20B.

Figure 21A:
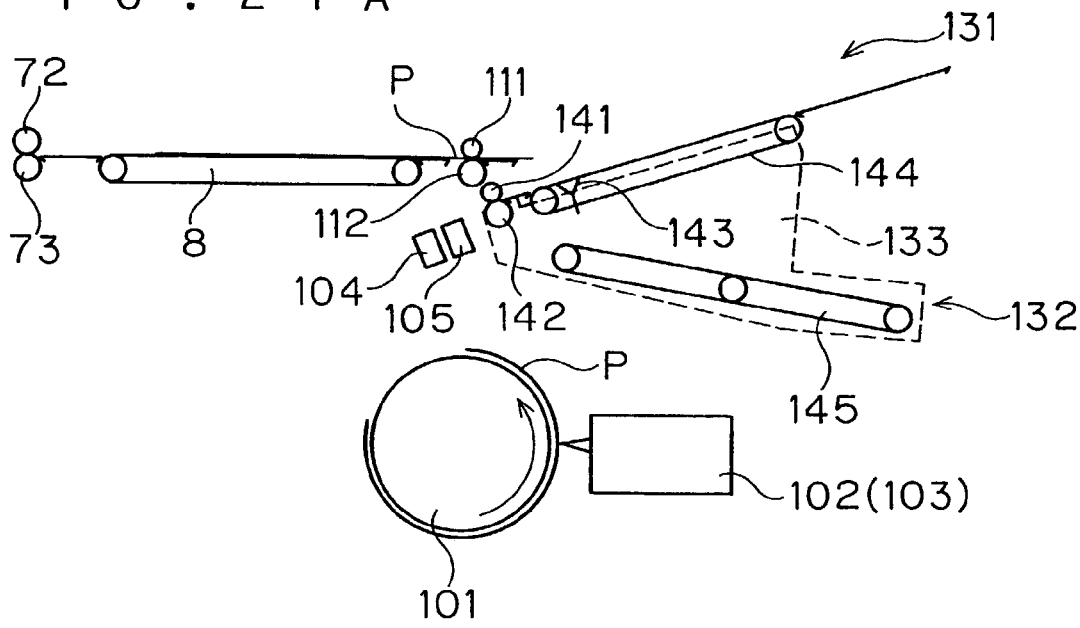

Next, the first plate P placed on the plate feed tray 131 is transported to the recording drum 101, and the leading and trailing edges of the first plate P is fixed by the leading edge clamp 116 and the trailing edge clamp 117, respectively, shown in FIG. 17. After the first plate P is mounted on the outer periphery of the recording drum 101, the plate feed tray 131 and the plate discharge tray 132 in the feed/discharge tray part 5 are placed in the first angular position, as shown in FIG. 21A. In this condition, the recording drum 101 is rotated at high speeds. At the same time, the recording heads 102 and 103 directing the optical beams on the first plate P are moved in the axial direction of the recording drum 101 to carry out the image recording on the first plate P. In this condition, a second plate P subsequent to the first plate P has been transported on the conveyor part 8, as shown in FIG. 21 A.

Figure 21B:
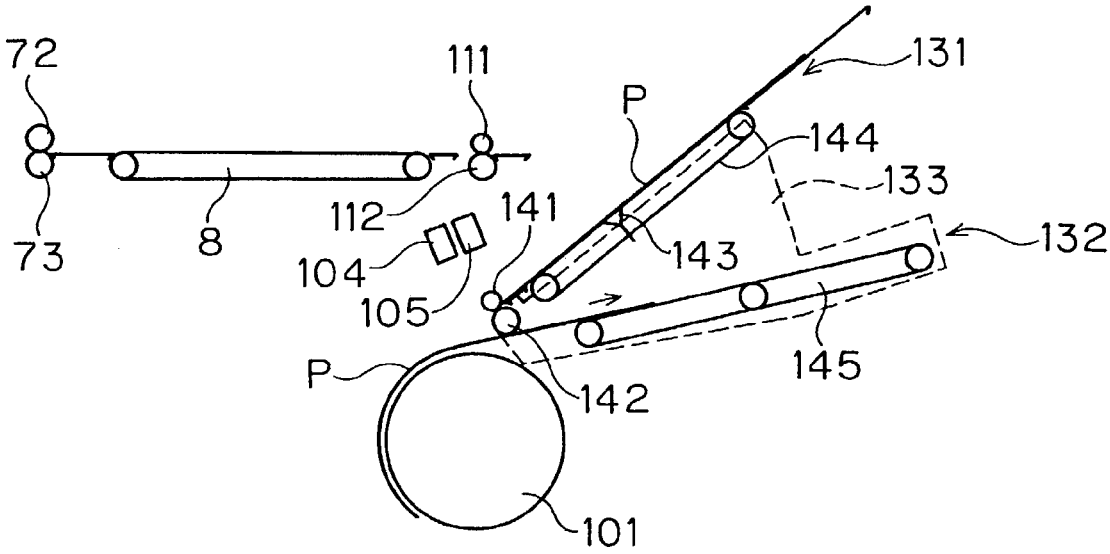

After the image recording on the first plate P, the plate feed tray 131 and the plate discharge tray 132 in the feed/discharge tray part 5 are placed again in the third angular position, as shown in FIG. 21B. Then, the first plate P subjected to the image recording is transported from the outer periphery of the recording drum 101 onto the plate discharge tray 132. At this time, the second plate P is placed on the plate feed tray 131 after being subjected to the positioning and the pin hole punching in similar processes to those described above.

Figure 22A:
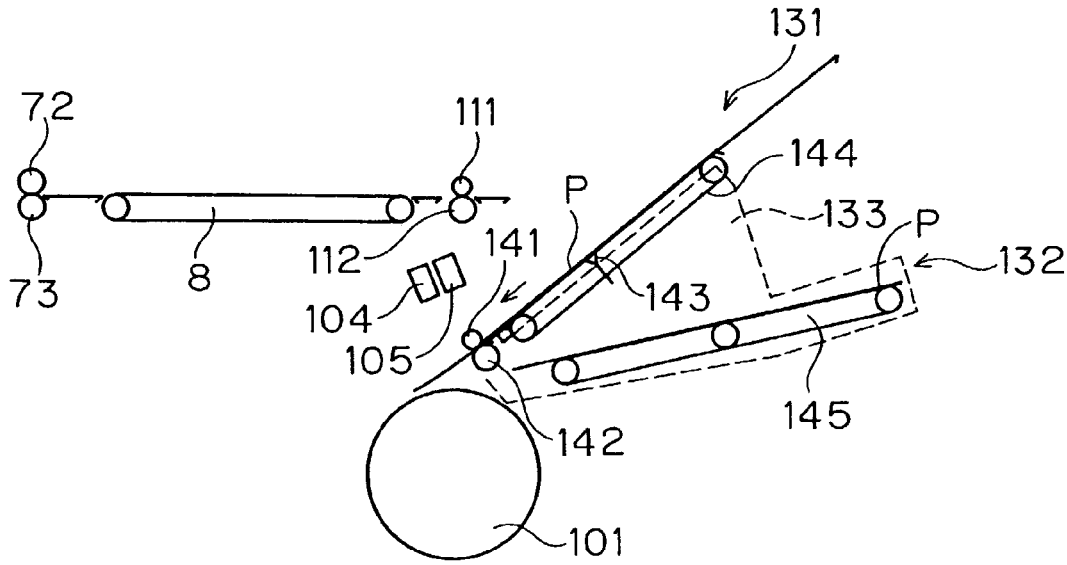
Figure 22B:
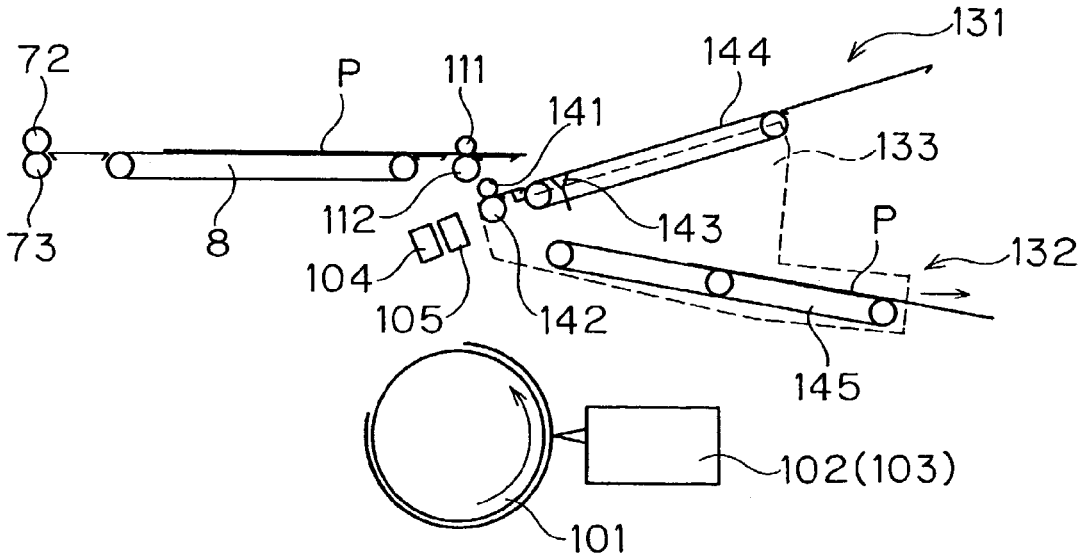

After the first plate P subjected to the image recording is placed on the plate discharge tray 132, the second plate P is transported toward the recording drum 101, as shown in FIG. 22B.

Then, the plate feed tray 131 and the plate discharge tray 132 in the feed/discharge tray part 5 are placed in the first angular position, as shown in FIG. 22B, and the image recording is carried out on the second plate P. In this condition, the first plate P previously subjected to the image recording is transported toward the transfer mechanism 7 in the subsequent stage. A third plate P subsequent to the second plate P has been transported on the conveyor part 8.

In the above-mentioned preferred embodiment, the multi-cassette part 3 and the autoloader part 4 carry out the operation of locating a desired one of the plurality of cassettes 9 in the plate feed position by the use of the combination of the horizontal movement and the vertical movement of the desired cassette 9. However, other techniques may be used. For example, only the vertical movement of the desired cassette 9 may be used to locate the desired cassette 9 in the plate feed position.

In the above-mentioned preferred embodiment, whether or not the plate is attached to the back surface of the interleaf is determined by the change in degree of vacuum in the interleaf-holding suction cups. However, if an interleaf having poor air permeability is used, it is contemplated that there is little difference between the degree of vacuum in the suction cups vacuum-holding only the interleaf and the degree of vacuum in the suction cups vacuum-holding the plate with the interleaf therebetween.

In such a case, the support 83 may be provided with, for example, a metal sensor for detecting the plate attached to the back surface of the interleaf. Alternatively, the lifting member 76 may be provided with a weight sensor for detecting a weight difference depending on whether or not only the interleaf is vacuum-held.

For separation of the plate P from the interleaf S, the suction pads 77 are moved horizontally in the above-mentioned preferred embodiment. However, the direction of movement of the suction pads 77 is not limited to the horizontal. For instance, if the cassette 9 is placed in an inclined position, there are cases where the suction pads 77 are moved in a direction other than the horizontal direction.

In the above-mentioned preferred embodiment, the discrimination is made as to whether or not the plate P is attached to the back surface of the interleaf S, and the movable suction pads 77 are moved in accordance with the result of discrimination. Instead, the movable suction pads 77 may be adapted to move at all times during the removal of the interleaf S out of the cassette. As an example, after the suction pads 77 vacuum-hold the interleaf, the horizontal reciprocal movement of the movable suction pads 77 may be started simultaneously with the start of the upward movement of the support 83, and be stopped when the support 83 reaches a predetermined height.

The air layers 93, 94, 95 and 96 are formed by reducing the distance between the movable and fixed suction pads 77 in the above-mentioned preferred embodiment. Instead, the air layers 93, 94, 95 and 96 may be formed by reducing a distance between the movable suction pads 77. Although the fixed suction pad 77*e* is disposed between the movable suction pads 77*d* and 77*f* in the above-mentioned preferred embodiment, the air layers are formed if the fixed suction pad 77*e* is dispensed with.

While the invention has been described in detail, the foregoing description is in all aspects illustrative and not restrictive. It is understood that numerous other modifications and variations can be devised without departing from the scope of the invention.

What is claimed is:

1. An interleaf removal apparatus for removing an interleaf from at least one stack of alternating plates and interleaves, said interleaf removal apparatus comprising:

(a) a support;

(b) a plurality of suction cups for holding and fixing an interleaf under suction, said plurality of suction cups including a plurality of fixed suction cups fixed to said support and a plurality of movable suction cups movably supported by said support, and being arranged linearly such that said plurality of movable suction cups are interposed between said plurality of fixed suction cups;

(c) a lifting element for vertically moving said plurality of suction cups together with said support with respect to said at least one stack;

(d) a suction element for causing said plurality of suction cups to exert suction; and (e) a suction cup moving element having a belt for moving said plurality of movable suction cups toward and away from said plurality of fixed suction cups in a direction substantially parallel to a top surface of said at least one stack.

2. The interleaf removal apparatus according to claim 1, wherein said plurality of movable suction cups is divided into two pairs of movable suction cups, and one pair of movable suction cups and the other pair of movable suction cups are connected respectively to different linear portions of the belt of said suction cup moving element.

3. A plate feed apparatus for feeding a plate to a recording apparatus for forming an image on said plate, said plate feed apparatus comprising:

(a) a storage part for storing therein at least one stack of alternating plates and interleaves; and (b) an interleaf removal mechanism for removing an interleaf from said at least one stack, said interleaf removal mechanism including:

(b-1) a support;

(b-2) a plurality of suction cups for holding and fixing said interleaf under suction, said plurality of suction cups including a plurality of fixed suction cups fixed to said support and a plurality of movable suctions cups movable supported by said support, and being arranged linearly such that said plurality of movable suction cups are interposed between said plurality of fixed suction cups;

(b-3) a lifting element for vertically moving said plurality of suction cups together with said support with respect to said at least one stack;

(b-4) a suction element for causing said plurality of suction cups to exert suction; and (b-5) a suction cup moving element having a belt for moving said plurality of movable suction cups toward and away from said plurality of fixed suction cups in a direction substantially parallel to a top surface of said stack.

4. The plate feed apparatus according to claim 3, wherein said plurality of movable suction cups is divided into two pairs of movable suction cups, and one pair of movable suction cups and the other pair of movable suction cups are connected respectively to different linear portions of the belt of said suction cup moving element.

5. The plate feed apparatus according to claim 4, wherein said storage part is configured for selectively performing a first storing operation and a second storing operation, said first storing operation being for storing a stack of alternating plates and interleaves in a middle position of said storage part, said second storing operation being for storing two stacks of alternating plates and interleaves in a direction of movement of said plurality of movable suction cups, said plurality of fixed suction cups include a middle fixed suction cup provided in a middle position of said support and two end-side fixed suction cups provided on both ends of said support, and each of said two pairs of movable suction cups is provided between said middle fixed suction cup and either of said two end-side fixed suction cups, and is linearly movable toward and away from each other with said middle fixed suction cup located in a middle position between said two pairs, an operating position of each of said movable suction cups for removing said interleaf from said at least one stack being settable depending on a state of storing in said storage part.

6. An image recording system comprising:

an image recording apparatus for recording an image on a plate; and a plate feed apparatus for feeding said plate to said image recording apparatus, said plate feed apparatus including:

(a) a storage part for storing therein at least one stack of alternating plates and interleaves; and (b) an interleaf removal mechanism for removing an interleaf from said at least one stack, said interleaf removal mechanism including:

(b-1) a support;

(b-2) a plurality of suction cups for holding and fixing said interleaf under suction, said plurality of suction cups including a plurality of fixed suction cups fixed to said support and a plurality of movable suctions cups movably supported by said support, and being arranged linearly such that said plurality of movable suction cups are interposed between said plurality of fixed suction cups;

(b-3) a lifting element for vertically moving said plurality of suction cups together with said support with respect to said at least one stack;

(b-4) a suction element for causing said plurality of suction cups to exert suction; and (b-5) a suction cup moving element having a belt for moving said plurality of movable suction cups toward and away from said plurality of fixed suction cups in a direction substantially parallel to a top surface of said at least one stack.

7. The image recording system according to claim 6, wherein said plurality of movable suction cups is divided into two pairs of movable suction cups, and one pair of movable suction cups and the other pair of movable suction cups are connected respectively to different linear portions of the belt of said suction cup moving element.

8. The image recording system according to claim 7, wherein said storage part is configured for selectively performing a first storing operation and a second storing operation, said first storing operation being for storing a stack of alternating plates and interleaves in a middle position of said storage part, said second storing operation being for storing two stacks of alternating plates and interleaves in a direction of movement of said plurality of movable suction cups, said plurality of fixed suction cups include a middle fixed suction cup provided in a middle position of said support and two end-side fixed suction cups provided on both ends of said support, and each of said two pairs of movable suction cups is provided between said middle fixed suction cup and either of said two end-side fixed suction cups, and is linearly movable toward and away from each other with said middle fixed suction cup located in a middle position between said two pairs, an operating position of each of said movable suction cups for removing said interleaf from said at least one stack being settable depending on a state of storing in said storage part.

* * * * *